US009478381B2

(12) United States Patent
Lauraire et al.

(10) Patent No.: US 9,478,381 B2
(45) Date of Patent: Oct. 25, 2016

(54) MODULAR ELECTRICAL SWITCH DEVICE COMPRISING AT LEAST ONE UNIPOLAR CUT-OFF UNIT AND A SWITCH ASSEMBLY COMPRISING SUCH DEVICES

(71) Applicant: SCHNEIDER ELECTRIC INDUSTRIES SAS, Rueil-Malmaison (FR)

(72) Inventors: Michel Lauraire, Saint Maur des Fosses (FR); Julien Henri-Rousseau, Grenoble (FR); Didier Vigouroux, Brignoud (FR); Patrick Larcher, Echirolles (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/649,120

(22) PCT Filed: Oct. 28, 2013

(86) PCT No.: PCT/FR2013/052561

§ 371 (c)(1),
(2) Date: Jun. 2, 2015

(87) PCT Pub. No.: WO2014/096580

PCT Pub. Date: Jun. 26, 2014

(65) Prior Publication Data

US 2015/0318133 A1 Nov. 5, 2015

(30) Foreign Application Priority Data

Dec. 18, 2012 (FR) ..... 12 62267

(51) Int. Cl.
*H01H 71/02* (2006.01)
*H01H 50/18* (2006.01)
(Continued)

(52) U.S. Cl.
CPC ..... *H01H 71/0228* (2013.01); *H01H 50/002* (2013.01); *H01H 50/04* (2013.01);
(Continued)

(58) Field of Classification Search
CPC .... H01H 50/002; H01H 50/04; H01H 50/64; H01H 50/18; H01H 50/14; H01H 50/44; H01H 50/54; H01H 71/0271; H01H 9/34; H01H 50/443; H01H 50/546; H01H 71/0228; H01H 71/082; H01H 2071/0278
See application file for complete search history.

(56) References Cited

U.S. PATENT DOCUMENTS 4,800,352 A * 1/1989 Haury ..... H01H 50/643 200/293
4,973,929 A * 11/1990 Duchemin ..... H01H 89/08 335/132
2004/0027776 A1 2/2004 Uotome et al.

FOREIGN PATENT DOCUMENTS

EP 0 645 792 3/1995
EP 1 353 348 10/2003

OTHER PUBLICATIONS

International Search Report Issued Mar. 25, 2014 in PCT/FR13/052561 filed Oct. 28, 2013.
(Continued)

*Primary Examiner* — Mohamad Musleh
(74) *Attorney, Agent, or Firm* — Oblon, McClelland, Maier & Neustadt, L.L.P.

(57) ABSTRACT

A modular electrical switch device including: a cut-off unit including unitary cut-off units; an actuating unit including an actuating module of the unitary cut-off units; a removable electrical control module including an adaptive connection mechanism configured to interconnect with an actuating coil of an electromagnetic actuator when the removable module is positioned on the actuating module; a quick attachment mechanism allowing the removable attachment of the actuating unit onto the cut-off unit and including a coupling hook configured to attach and hold the cut-off unit to the actuating unit, and to engage with an actuating device of a unitary cut-off unit.

14 Claims, 14 Drawing Sheets

(51) Int. Cl.

| | |
|---|---|
| ***H01H 50/14*** | (2006.01) |
| ***H01H 50/44*** | (2006.01) |
| ***H01H 50/54*** | (2006.01) |
| ***H01H 50/64*** | (2006.01) |
| ***H01H 50/00*** | (2006.01) |
| ***H01H 50/04*** | (2006.01) |
| ***H01H 71/08*** | (2006.01) |
| *H01H 9/34* | (2006.01) |

(52) U.S. Cl.
CPC ..... *H01H 50/14* (2013.01); *H01H 50/18* (2013.01); *H01H 50/44* (2013.01); *H01H 50/54* (2013.01); *H01H 50/64* (2013.01); *H01H 71/0271* (2013.01); *H01H 71/082* (2013.01); *H01H 9/34* (2013.01); *H01H 50/443* (2013.01); *H01H 50/546* (2013.01); *H01H 2071/0278* (2013.01)

(56) References Cited

OTHER PUBLICATIONS

U.S. Appl. No. 14/650,452, filed Jun. 8, 2015, Larcher, et al.

* cited by examiner

MODULAR ELECTRICAL SWITCH DEVICE COMPRISING AT LEAST ONE UNIPOLAR CUT-OFF UNIT AND A SWITCH ASSEMBLY COMPRISING SUCH DEVICES

TECHNICAL FIELD OF THE INVENTION

The invention relates to a modular electrical switching device comprising a switching block comprising unitary switching blocks respectively having electrical switching means. An actuation block comprises an actuation module of the unitary switching blocks, said module integrating an electromagnetic actuator controlled by control means. The modular switching device further comprises means allowing the actuation block to be removably fixed onto the switching block.

The invention also relates to an electrical switching assembly comprising a first and a second modular electrical switching device placed side-by-side and being electrically connected.

PRIOR ART

The use of unitary switching blocks in multiple-pole protection and/or switching devices such as circuit breakers, contactor-circuit breakers, and contactors is known. The unitary switching blocks can be housed in a multiple-pole casing (U.S. Pat. No. 4,684,772). The multiple-pole devices are then modular inasmuch as one and the same switching block can be duplicated three times in a three-pole switching device and four times in a four-pole device.

When a number of switching blocks are assembled in a casing of a switching device, there then notably arises the problem of the synchronized control of the different switching blocks. More or less complex existing solutions describe means for controlling and actuating the switching blocks. The use of complex control means can present problems of reliability over time.

Furthermore, some switching devices comprise electrical control means. The use of electrical control means generally greatly reduces the volume of the device and its consumption. It also paves the way for the contactor to have communication. However, if the control means are driven and powered by control electronics, additional problems can appear. In effect, the level and the periods of maintenance required by the electronic means and the electromechanical means included in the same device are not the same bearing in mind that the overall maintenance has to remain easy and inexpensive. This is all the more so since the lifetimes of the electrical control means and of the associated electromechanics can be very different depending on the applications.

Thus, the modularity of the switching device enables the user to obtain a product whose performance levels are truly suited to the use that he or she makes thereof. The corollary of this modularity is the certain complexity of production of such a multiple-pole switching device. The complexity is real in terms of production of the architecture and in terms of the maintenance of the switching device.

The modularity of the multiple-pole switching device can also relate to the installation and the use of an electronic thermal protection device. The incorporation of a removable electronic thermal protection in the volume of the switching device is then possible at the cost of adaptation means of a certain complexity. This additional complexity can be all the greater when a number of switching devices are linked together to control a motor notably according to an installation in reversing switch mode.

DISCLOSURE OF THE INVENTION

The invention therefore aims to remedy the drawbacks of the prior art, by proposing an electrical switching device with electronic control comprising a simplified modular architecture accepting one or more switching blocks.

The modular electrical switching device according to the invention comprises:

- a removable electrical control module incorporating the control means and comprising adaptive connection means intended to be interconnected with an actuation coil of the electromagnetic actuator when said removal electrical control module is positioned on the actuation module,
- rapid fixing means allowing a removable fixing of the actuation block onto the switching block and comprising at least one coupling hook intended:
- to fix and secure the switching block to the actuation block, and
- to collaborate with an actuation device of a mobile contact of the unitary switching block to transmit the movement of the electromagnetic actuator to said mobile contact;

said coupling hook being secured to the mobile keeper of the electromagnetic actuator.

According to one mode of development of the invention, the actuation coil comprises control windings respectively comprising connection terminals. In a first configuration, the adaptative connection means of the removable electrical control module are arranged to be connected to the connection terminals and place the control windings in series, and in a second configuration, said adaptative connection means are arranged to be connected to the connection terminals and place the control windings in parallel.

Preferably, the adaptive connection means comprise electrical tracks directly incorporated in a printed circuit of the removable electrical control module so as to connect the two control windings in series.

Preferably, the adaptive connection means comprise electrical tracks directly incorporated in a printed circuit of the removable electrical control module so as to connect the two control windings in parallel.

According to one mode of development of the invention, the modular electrical switching device comprises a removable thermal protection module comprising, in a casing, current sensors intended to be positioned around connection lands of the unitary switching blocks of the switching block, said casing being removable relative to the modular switching device.

Preferably, the removable thermal protection module comprises communication and electrical power supply means intended to be automatically connected with the removable electrical control module, said communication and power supply means being arranged to power the removable thermal protection module and to transmit the measurements performed by the current sensors.

Preferably, the unitary switching blocks are respectively controlled in a synchronized manner by the actuation block to control the opening of the electrical contacts by displacing the mobile contacts.

Preferably, the coupling hook of the fixing means is secured to a mobile keeper of the electromagnetic actuator.

According to a particular embodiment of the invention, the coupling block comprises an edge comprising a bearing surface suitable for transmitting the movements of the mobile keeper to the mobile contact from the closed position to the open position and vice versa.

Preferably, a first edge of the coupling hook comprises a slot which is intended to receive an attachment head of a mobile contact-holder, said first edge comprising a bearing surface intended to transmit the movement of the mobile keeper to a mobile contact-holder of the mobile contact in a first direction of movement from the closed position to its open position.

Preferably, a second edge comprises a bearing surface intended to transmit the movement of the mobile keeper to the mobile contact-holder of the mobile contact in a second direction of movement, from the open position to its closed position.

Advantageously, the modular electrical switching device comprises three unitary switching blocks, the actuation devices of said blocks being respectively controlled in a synchronized manner by the actuation block, to control the opening of the electrical contacts by displacing the mobile contacts.

Preferably, the actuation block comprises a tray fixed to the mobile keeper, said tray having three coupling hooks intended respectively to collaborate with an attachment head of a snug of a mobile contact-holder secured to a mobile contact of a unitary switching block.

The electrical switching assembly according to the invention comprises electrical conductors positioned respectively in second cavities of the two bases of the two modular contactors.

BRIEF DESCRIPTION OF THE FIGURES

Other advantages and features will emerge more clearly from the following description of particular embodiments of the invention, given as nonlimiting examples, and represented in the attached drawings in which.

DETAILED DESCRIPTION OF AN EMBODIMENT

Figure 1:
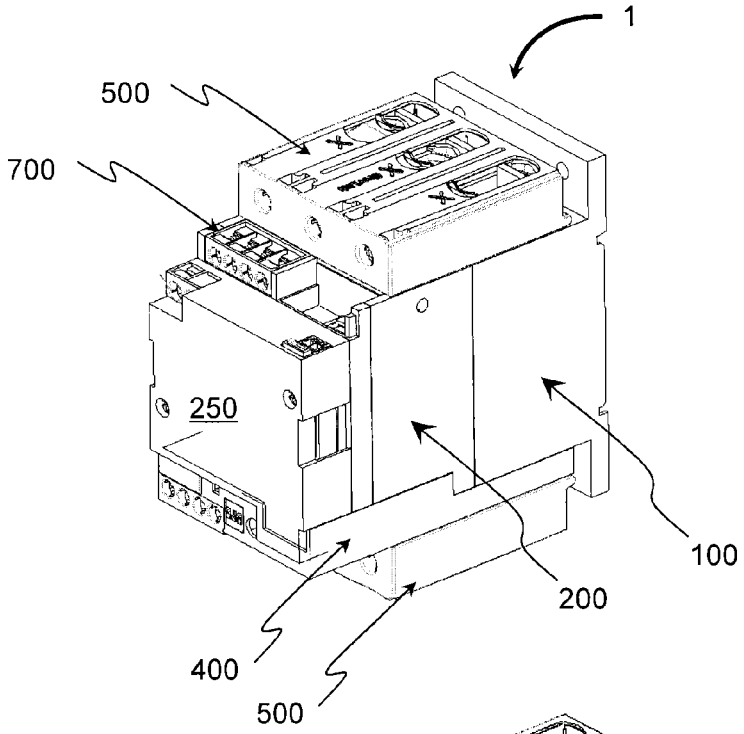
FIG. 1 represents a perspective view of a modular electrical switching device according to the invention.

The modular electrical switching device 1 according to the invention as represented in FIG. 1 comprises a switching block 100 associated with an actuation block 200. The modular electrical switching device 1 is preferably a contactor. The terms contactor or switching device or modular electrical switching device will hereinbelow be used without distinction.

According to a preferential embodiment of the invention, the modular contactor 1 according to the invention comprises rapid fixing means allowing the actuation block 200 to be removably fixed onto the switching block 100.

Figure 10A:
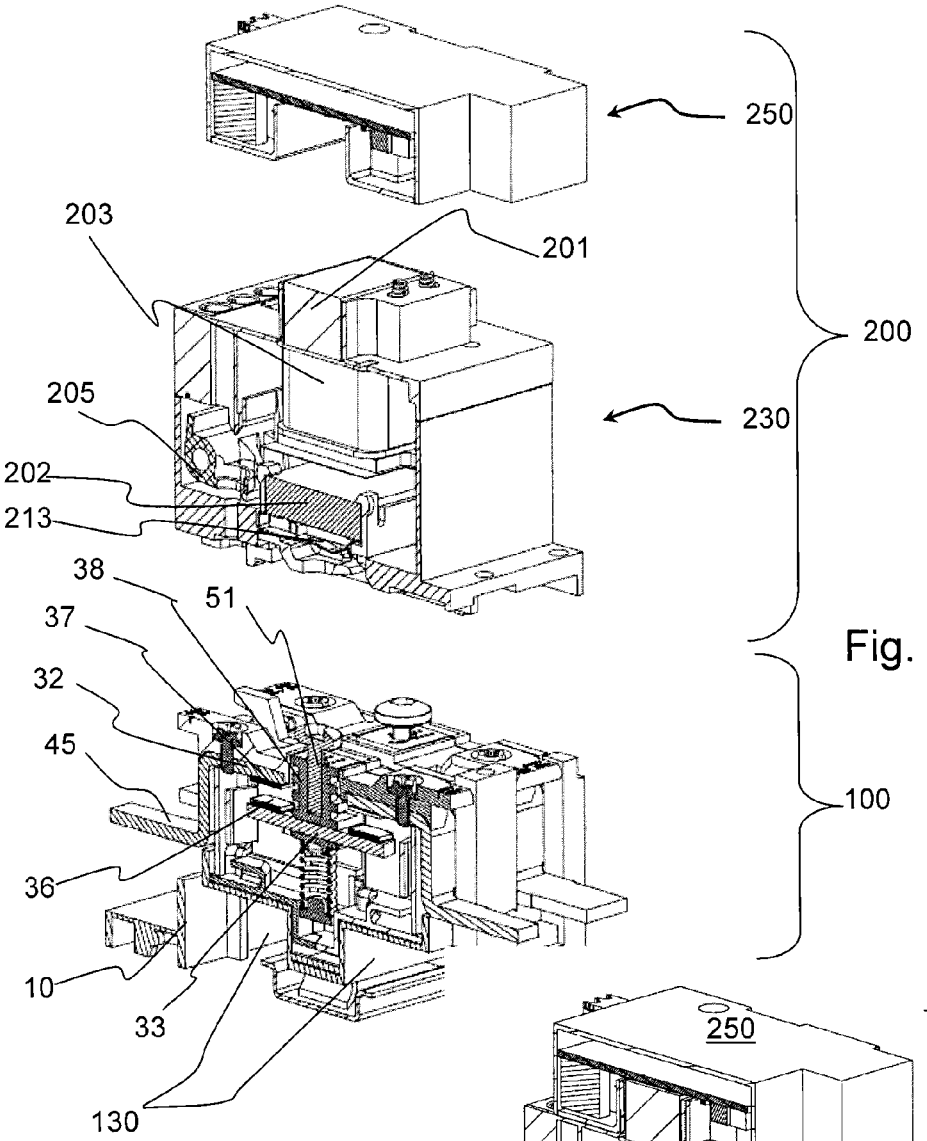
FIGS. 10A and 10B represent partial cross-sectional views of a modular electrical switching device according to the invention during mounting.
Figure 10B:
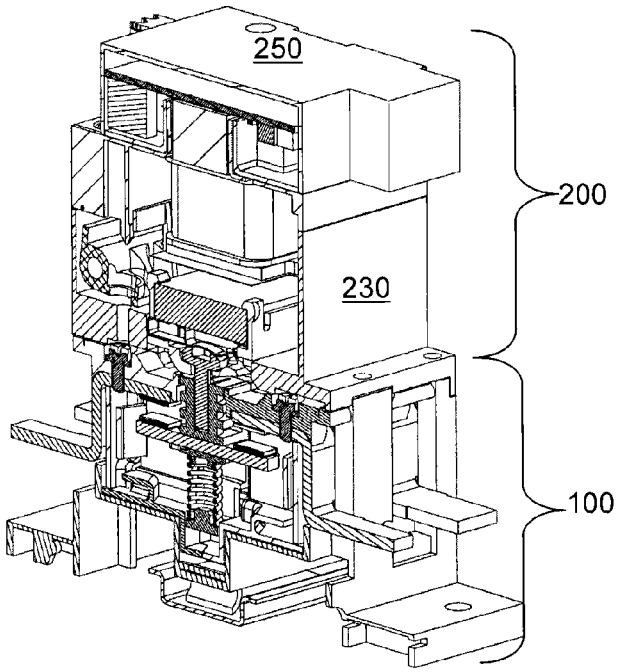

Furthermore, according to this preferential embodiment of the invention, as represented in FIGS. 10A and 10B, the actuation block 200 comprises an actuation module 230 connected to a removable electrical control module 250.

The removable electrical control module 250 can comprise electrical control means powered by control electronics. The terms removable electrical control module 250 or removable electronic control module 250 will be used hereinbelow without distinction.

The actuation module 230 comprises, in a known manner, an actuator of electromagnetic type more particularly comprising a fixed yoke 201 and a mobile keeper 202 suitable for being displaced relative to the fixed yoke 201 between two positions, an open position and a closed position. The electromagnetic actuator also comprises an actuation coil which, when it is passed through by a control current, makes it possible to displace the mobile keeper 202 from its open position to its closed position.

Figure 3:
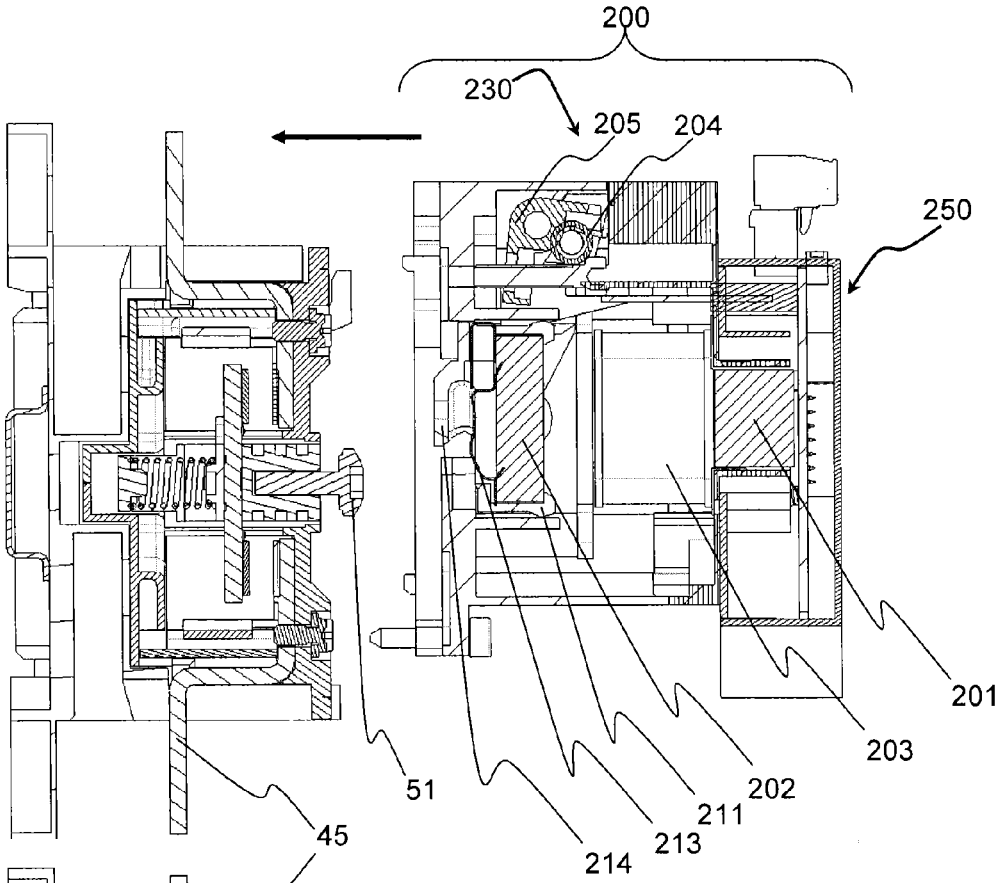
FIG. 3 represents a cross-sectional view of a switching block and of an actuation block according to FIG. 2 in a non-assembled position.
Figure 4:
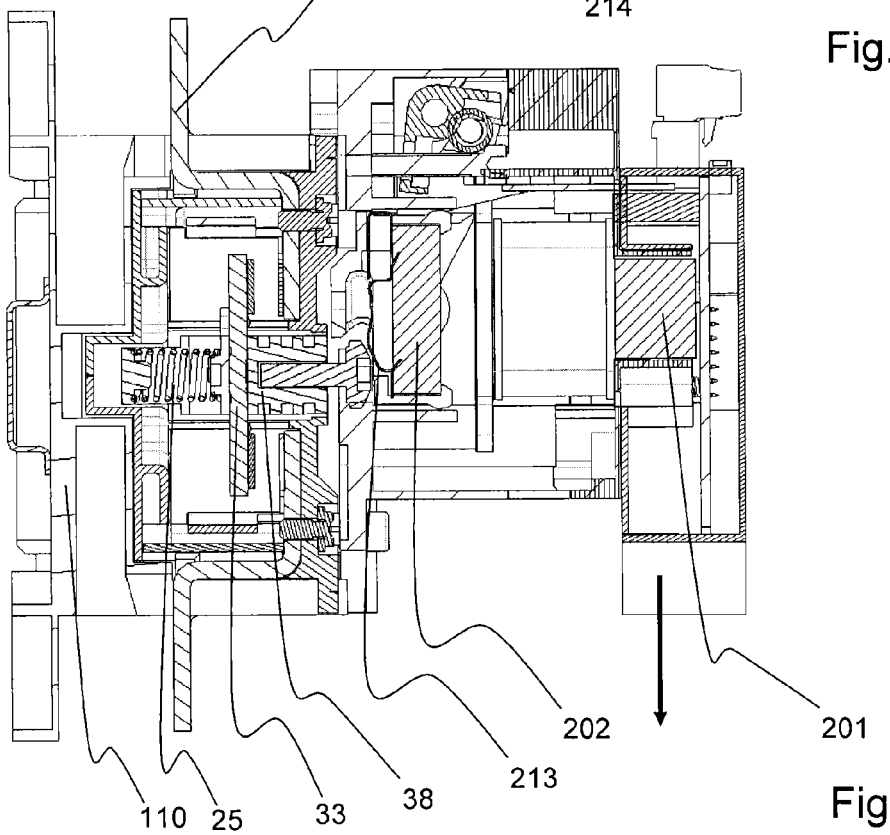
FIG. 4 represents a cross-sectional view of a switching block and of an actuation block according to FIG. 2 in a position during assembly.

A return spring 204 makes it possible to displace the mobile keeper 202 from its closed position to its open position. According to a particular embodiment as represented in FIGS. 3 and 4, the return spring 204 acts on the mobile keeper 202 via a rotary lever 205.

Figure 5A:
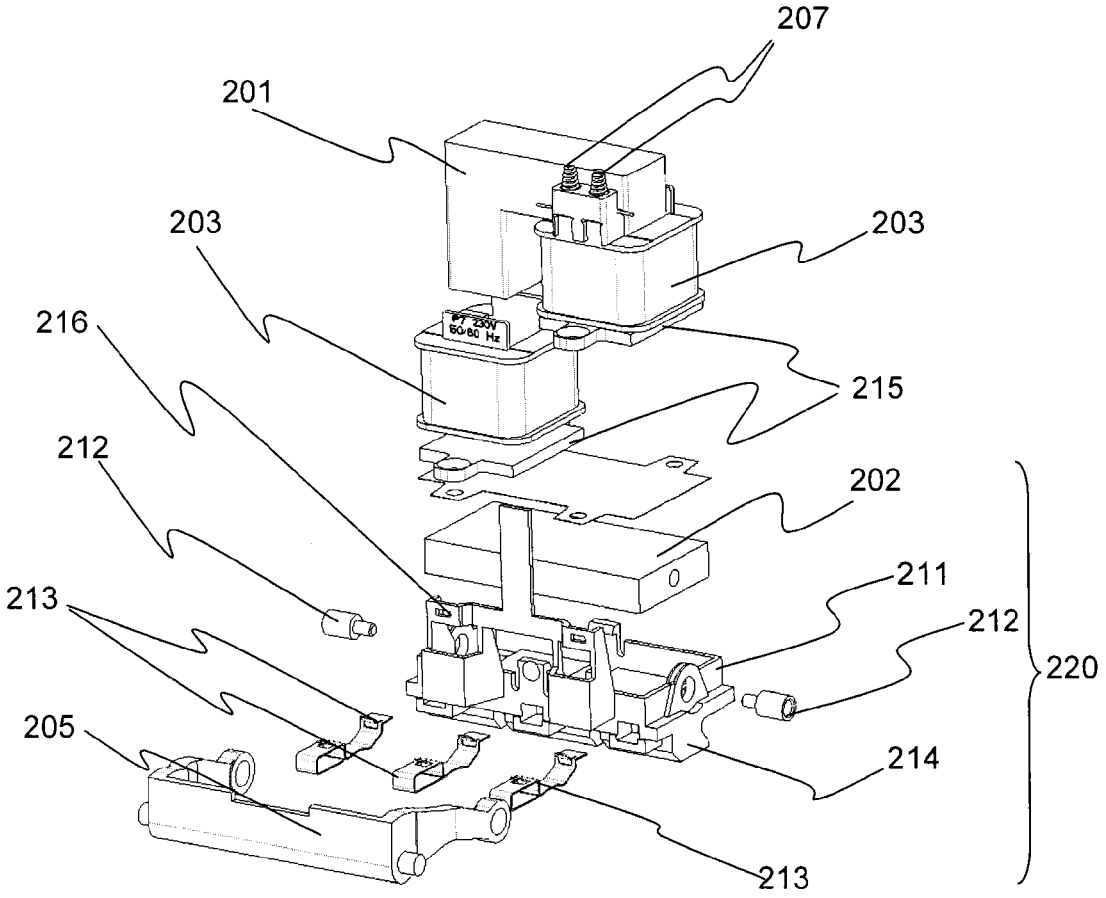
FIG. 5A represents a perspective exploded view of an actuation block of a modular electrical switching device according to FIG. 1.
Figure 5B:
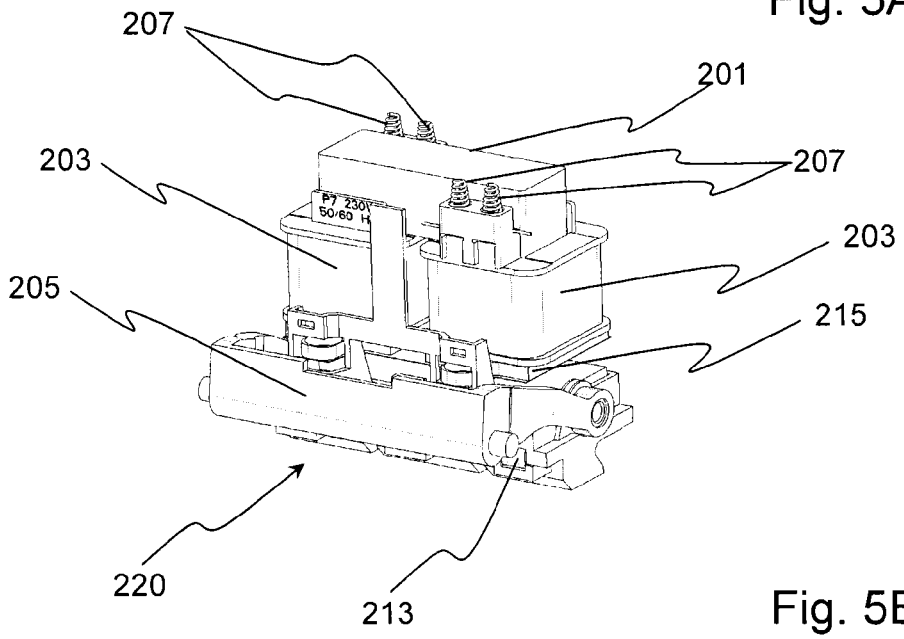
FIG. 5B represents a perspective view of an actuation block of a modular electrical switching device according to FIG. 5A.

According to a preferential mode of development of the actuator represented in FIGS. 5A, 5B, the fixed keeper 201 comprises a U-shaped section comprising two outer branches and a transverse keeper secured to a first end of the outer branches. The actuator comprises an actuation coil preferably comprising two electrically linked control windings 203. The two windings respectively comprise a longitudinal axis substantially merged with that of the outer branches of the U-shaped magnetic yoke. In effect, said control windings 203 are wound on insulating field frames placed on the outer branches of the magnetic yoke 201. The two control windings 203 are preferentially identical.

According to an embodiment of the invention as represented in FIGS. 5A and 5B, the return spring 204 is suitable for displacing a mobile assembly 220 from its closed position to its open position. As represented in FIG. 5B, the mobile assembly 220 comprises the mobile keeper 202 of the actuator positioned in a tray 211. The return spring acts on a multifunction lever 215 secured to the tray 211. Said multifunction lever 205 is arranged to manage a balancing of the mobile keeper 202 in order to allow simultaneous closure of the three power poles while reducing friction.

Figure 29A:
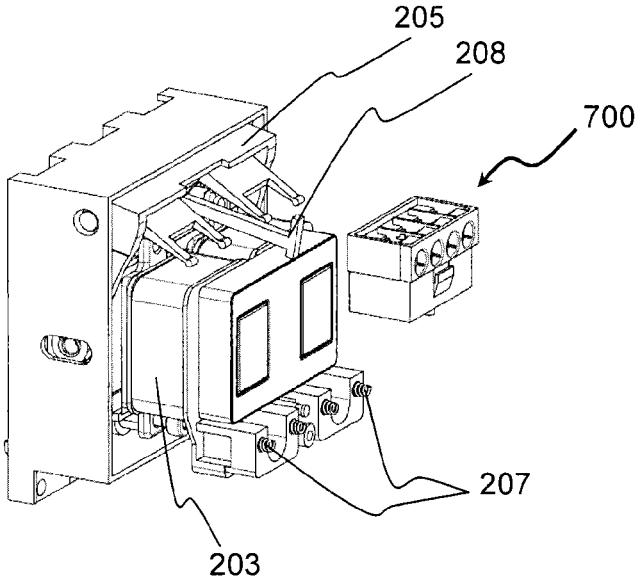
FIGS. 29A and 29B represent perspective views of auxiliary contact blocks in a second particular mode of development of the invention.
Figure 29B:
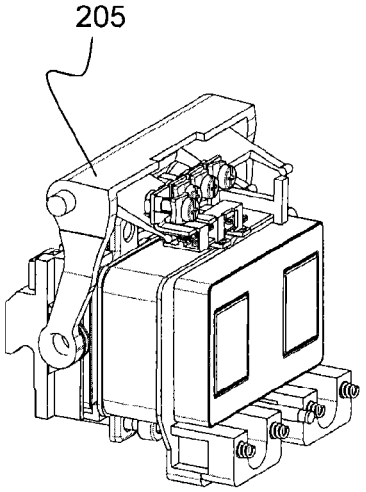

As represented in FIGS. 29A and 29B, the multifunction lever 205 also makes it possible to drive the auxiliary contact blocks and provide an indication on the front face of the modular electrical switching device 1.

Figure 31A:
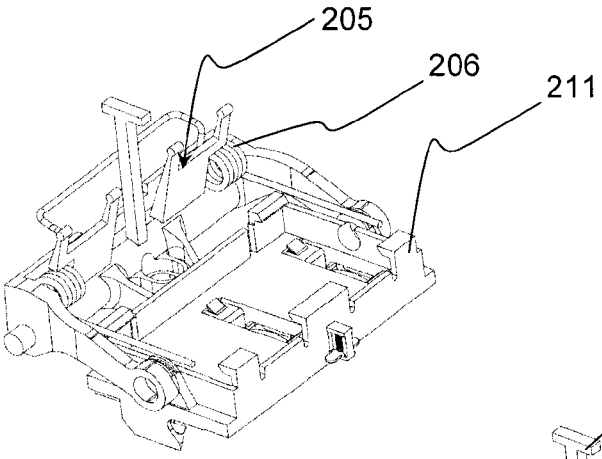
FIGS. 31A and 31B represent perspective views of variant embodiments of a mobile assembly 220 of an actuation block of a modular switching device according to the invention.
Figure 31B:
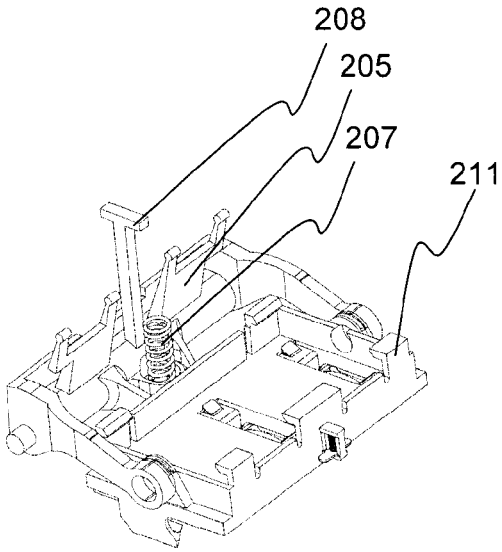

As represented in FIGS. 31A and 31B, the multifunction lever 205 can be controlled in two ways. As represented in FIG. 31A, a torsion spring 206 is used to keep it in an operating position. As represented in FIG. 31B, a compression spring is used to keep it an operating position.

The actuator also preferably comprises pole plates 215 fixed onto the outer branches of the U-shaped magnetic yoke. Said plates make it possible to improve the magnetic behavior of the actuator.

The actuator can be of monostable or bistable type. In the case of a bistable actuator, said actuator comprises at least one permanent magnet preferably placed between the two pole plates 215.

According to one mode of development of the invention not represented, the magnetic yoke 201 comprises an E-shaped section having two outer branches, at least one central branch, and a transverse keeper secured to a first end of the outer and central branches. The mobile keeper is placed facing the second ends of the outer branches and is displaced in translation. The mobile keeper also comprises an E-shaped section comprising two outer branches, at least one central branch, and a transverse keeper secured to a first end of the outer and central branches. The control coil comprising a longitudinal axis substantially merged with that of the central branch of the E-shaped magnetic yoke. In effect, said control coil comprises a winding wound on an insulating field frame placed on the central branch of the magnetic yoke.

The actuator is positioned in a casing of the actuation module 230. The control windings 203 of the actuation coil comprise connection terminals 207 intended to come into contact with adaptive connection means of the removable electrical control module 250. As represented notably in FIG. 5B, each control winding 203 comprises two connection terminals 207.

Figure 28A:
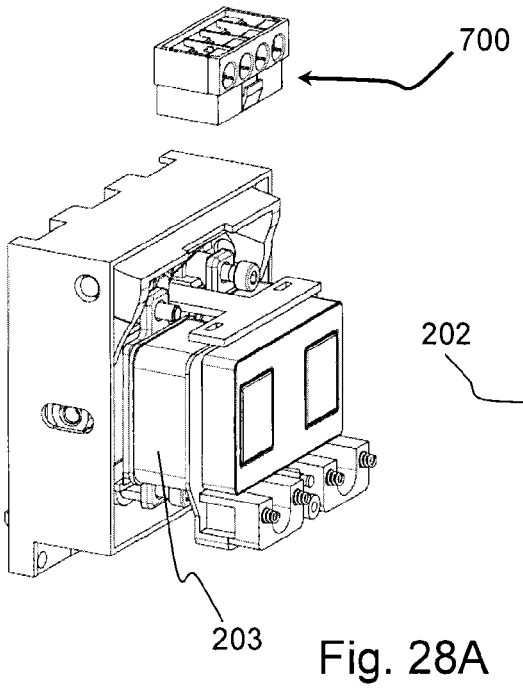
FIGS. 28A and 28B represent perspective views of auxiliary contact blocks in a first particular mode of development of the invention.

According to a first exemplary embodiment as represented in FIG. 28A, the four connection terminals 207 of the two control windings 203 are preferably aligned. According to a second exemplary embodiment as represented in FIG. 5B, the four connection terminals 207 of the two control windings 203 are preferably arranged diagonally. These two arrangements of the terminals 207 notably make it possible to adapt to different configurations of the removable electrical control module 250.

According to this preferential embodiment of the invention, the removable electrical control module 250 comprises electronic control means powered by control electronics. The removable electronic control module 250 is then intended to ensure a repetitive and constant operation of the actuator for a wide power supply voltage range. Said removable electronic control module is positioned and fixed on the casing of the actuation module 230. At the time of its positioning on said casing, the connection terminals 207 of the control windings 203 are automatically interconnected with the adaptive connection means of the removable electronic control module 250. According to a preferential embodiment, the adaptive connection means are incorporated directly on a printed circuit board PCB of the removable electrical control module 250. Depending on the version of the electronic control means used and depending on the control voltage of the modular contactor, the connection between the two control windings 203 shrewdly distributed on the two outer branches of the magnetic yoke 201 of the actuator can be made in series or in parallel. The adaptive connection means allow for a series or parallel connection of the two control windings 203 at the time of the connection of the removable electrical control module 250 to the actuation module 230. The adaptive connection means thus allow for a wider adaptation to the needs of the application while retaining an actuation coil that is common to all the applications.

According to a first particular embodiment of the adaptive connection means, the printed circuit board (PCB) of the removable electrical control module 250 comprises electrical tracks designed and configured in order to connect the terminals 207 of the control windings 203 in series.

According to a second particular embodiment of the adaptive connection means, the printed circuit board (PCB) of the removable electrical control module 250 comprises electrical tracks designed and configured in order to connect the terminals 207 of the control windings 203 in parallel. The control commands and the power supply for the control windings 203 pass via these connection terminals 207.

This removable electrical control module 250 can comprise a number of variants depending on the application targeted (notably depending on the network voltage). Said module is preferably mounted last on a contactor or a contactor equipped with a thermal protection (starter). The final choice of the electrical control module to be installed thus allows the installer to make a delayed differentiation. This removable electrical control module 250 can also be provided with connections allowing for communication, for example with a management computer of the installation, or a configuration tool.

The switching block 100 of the contactor 1 according to the invention comprises one or more electrical poles. According to the embodiment represented in FIGS. 1 and 2, the contactor comprises three electrical poles, and it is therefore called three-pole contactor. A unitary switching block 80, also commonly called switching bulb is then associated with each electrical pole. The three unitary switching blocks 80 are then controlled in a synchronized manner by the actuation block 200 acting on actuation devices 34 of the unitary switching blocks 80.

According to a particular embodiment, the switching blocks can be controlled in a synchronized and simultaneous manner. In other words, all the blocks are displaced then at the same time.

According to another particular embodiment, the switching blocks can be controlled in a synchronized and non-simultaneous manner. In other words, all the blocks are displaced by virtue of the action of the actuation block but a time offset is observed between the displacement of each block. This time offset is reproducible and controlled.

Figure 12:
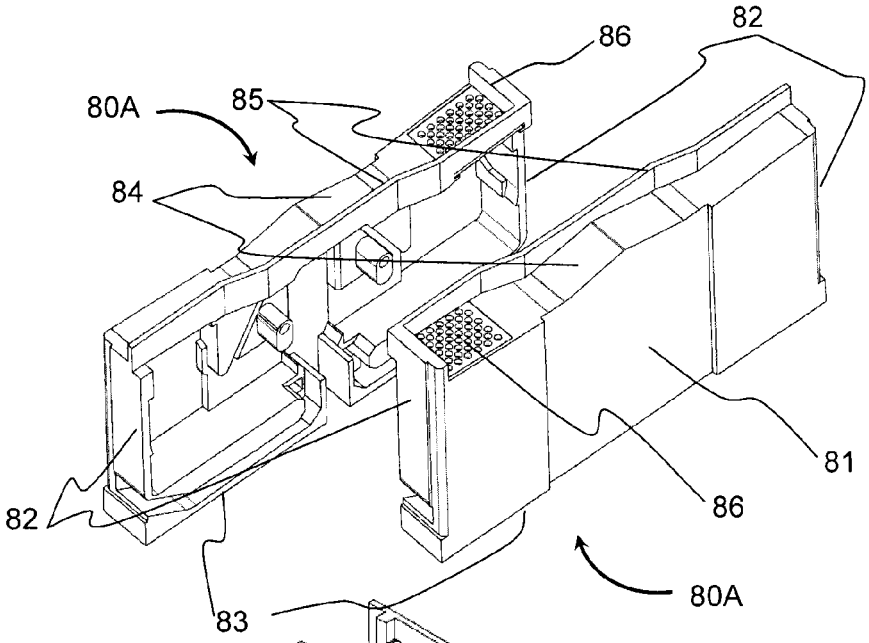
FIG. 12 represents the two half-shells of a switching block according to FIG. 11 during assembly.
Figure 15:
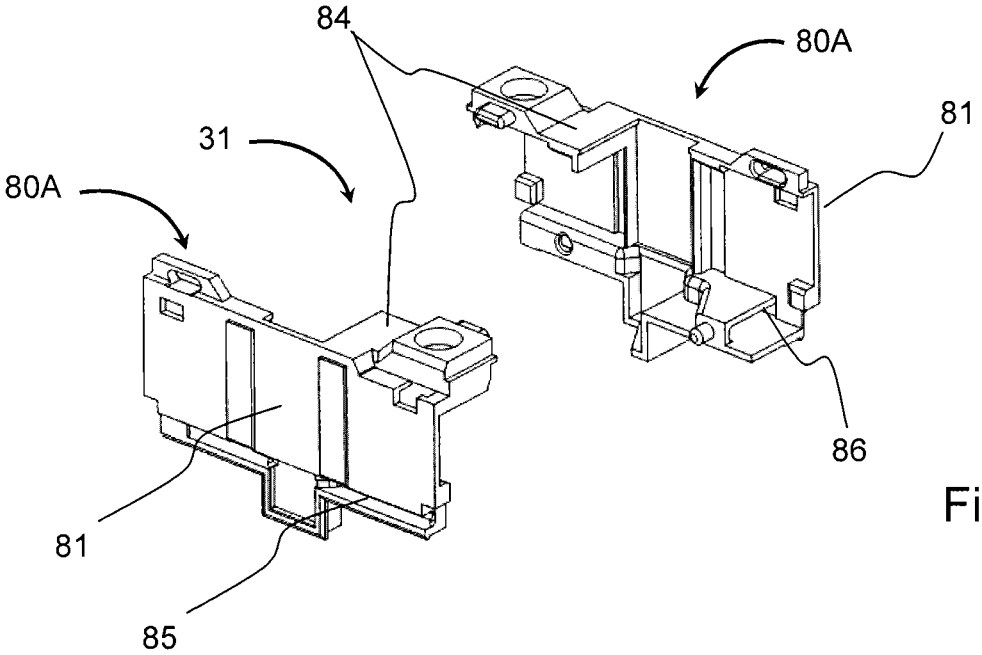
FIG. 15 represents two half-shells of a switching block according to FIG. 14 during assembly.

As represented in FIGS. 12 and 15, the unitary switching blocks 80 according to the invention comprise a casing 31 formed by two half-shells 80A. The two half-shells 80A of the casing 31 are preferably made of molded plastic material. Electrical contacts are positioned inside the casing 31. The half-shells 80A are assembled to form an assembly of substantially parallelepipedal form developing in a longitudinal plane of reference XZ.

According to a particular embodiment, the two half-shells 80A forming the casing 31 are preferably of identical form. As an example, "identical form" should be understood to mean the fact that the two half-shells, preferably produced by molding, are obtained from one and the same die. This offers the industrial advantage of managing a single variant part and a single investment. The casing 31 then comprises two main faces 81 arranged parallel to the longitudinal plane XZ. Said casing further comprises two lateral faces 82, a top face 83 and a bottom face 84.

Figure 16:
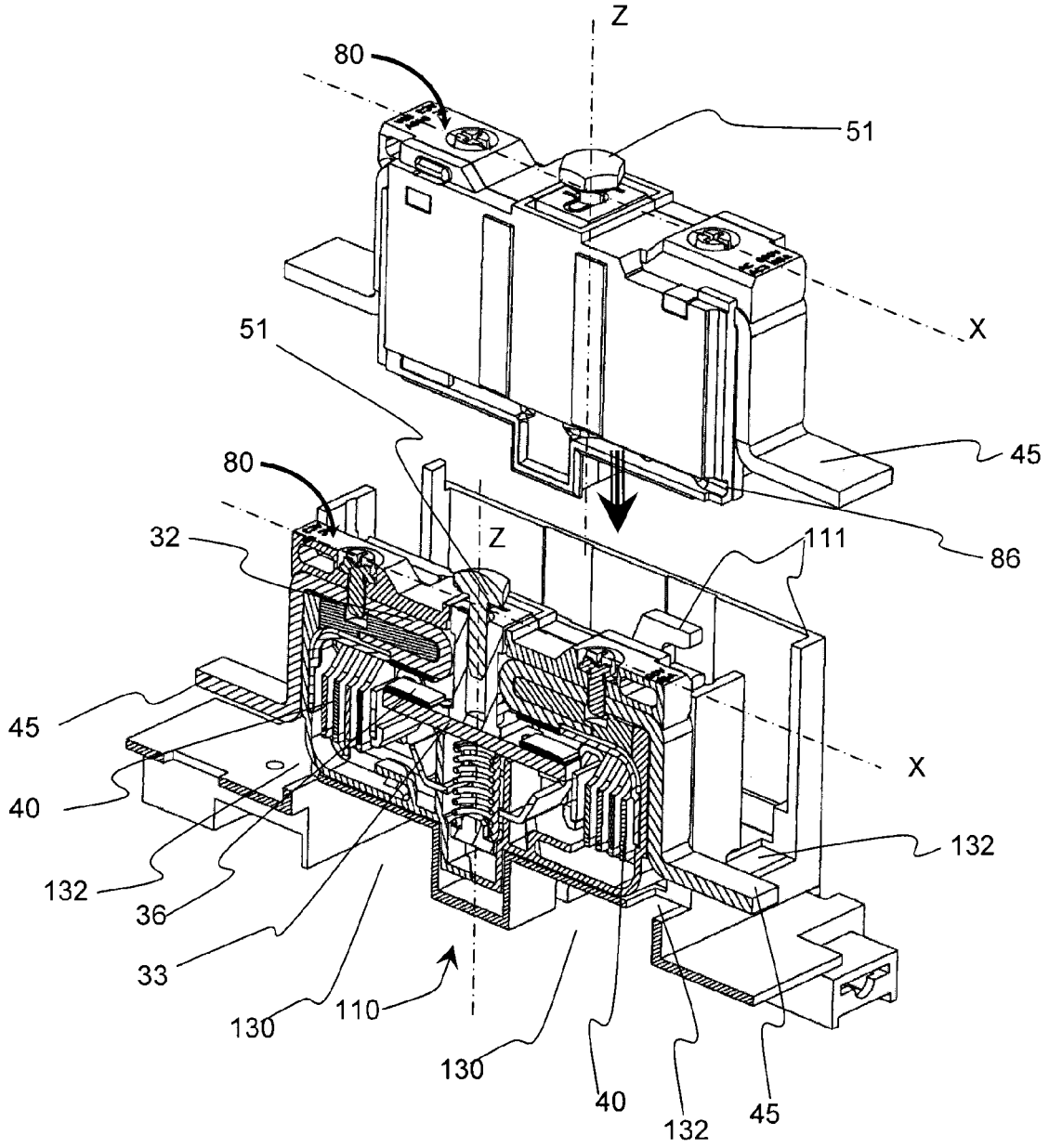
FIG. 16 represents a perspective view in partial cross section of a switching block according to one embodiment.
Figure 17:
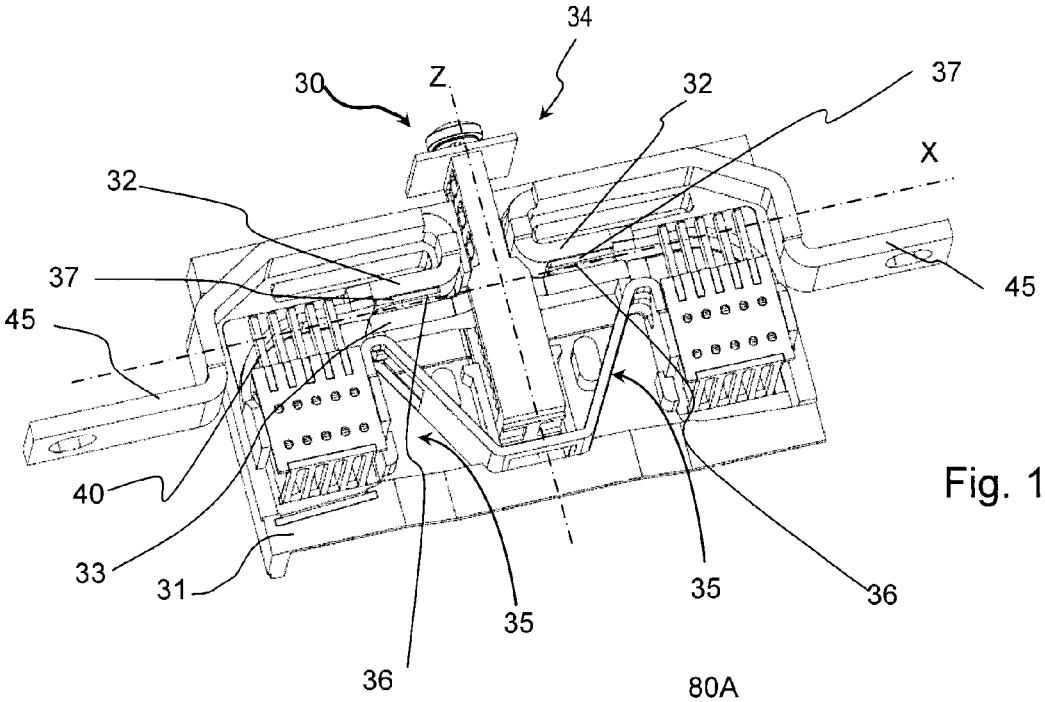
FIGS. 17 and 18 represent perspective views of different particular embodiments of the switching means of a unitary switching block.

As represented in FIGS. 16 and 17, the unitary switching block 80 comprises electrical switching means 30 consisting of two fixed contacts 32 respectively linked to an electrical connection terminal block 500 by connection lands 45. The two fixed contacts 32 respectively comprise an electrical contact area 37. The electrical switching means 30 are then positioned in an internal volume of the casing 31, an internal volume delimited by the two half-shells 80A.

The electrical switching means 30 further comprise a mobile contact 33 in the form of a bridge comprising an elongate body along a longitudinal axis X. According to this embodiment, the mobile contact bridge 33 comprises two ends on which are positioned two contact areas 36 that can each respectively collaborate with a contact area 37 of a fixed contact 32 in a position of closure of the switching means.

The terms "mobile contact" or "mobile contact bridge" will be without distinction hereinafter in the description.

In this position of closure, an elastic means 25, such as, notably, a helical spring, makes it possible to ensure, between the contact areas 36 and 37, a sufficient contact pressure to guarantee the establishment and the flow of current in good conditions. The elastic means 25 is generally called pole spring. This contact pressure is also provided for the permanent flow of current without excessive overheating, and to guarantee sufficient electrical durability.

Two opening volumes 35 are thus defined, corresponding to the space in which a contact area 37 of a fixed contact 32 and a contact area 36 associated with the mobile contact 33 are arranged. Furthermore, each opening volume 35 is associated with an arc-extinguishing chamber. The arc-extinguishing chamber opening onto the opening volume 35 is delimited by two parallel walls placed either side of the longitudinal geometrical plane of reference XZ, a back wall away from the opening volume 35, a bottom wall and a top wall.

According to an embodiment of the arc-extinguishing chamber, said chamber can comprise a stack of at least two planar metal plates 40 at right angles to the longitudinal geometrical plane of reference XZ. These metal plates, called fins, are intended to deionize the arc. The metal plates 40 are preferably made of ferromagnetic material. Said fins tend to exert a ferromagnetic attraction force on the arc. Said fins are of substantially rectangular form and comprise a longitudinal axis and a median axis.

Figure 18:
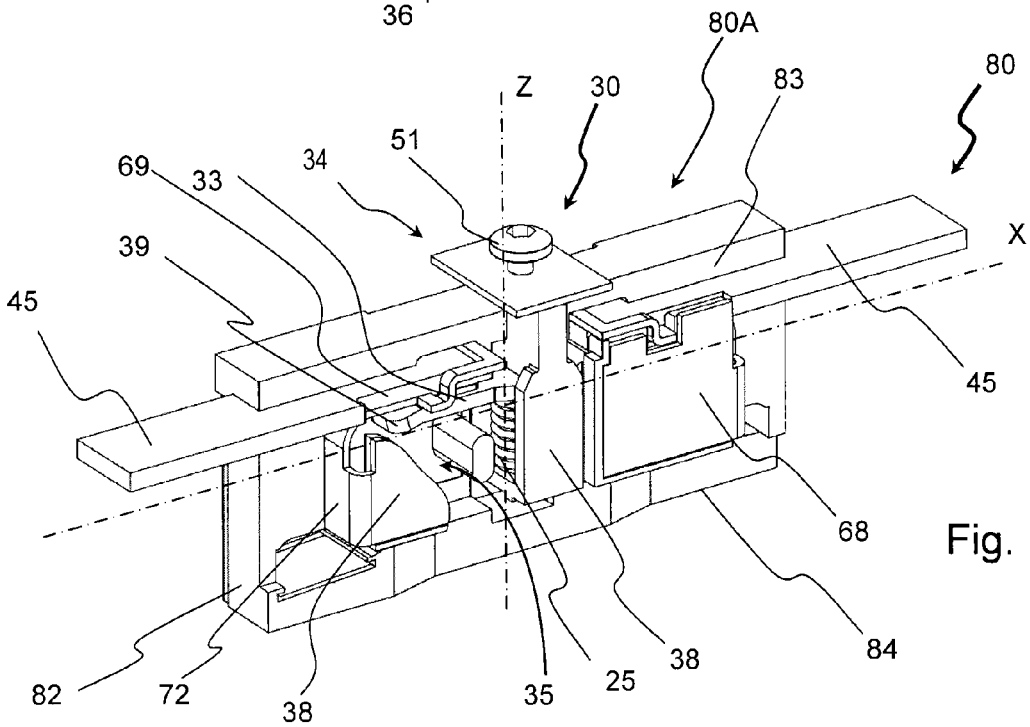

According to another particular embodiment of the arc-extinguishing chamber as represented in FIG. 18, said chamber is delimited by two flanges 68 of ferromagnetic material. The two lateral flanges 68 are parallel and placed either side of a median longitudinal plane XZ. The two lateral flanges 68 are arranged in such a way as to frame one of the ends of the mobile bridge 33 over its entire displacement between the position of opening and the position of closure. In other words, the two lateral flanges 68 are spaced apart from one another to allow the displacement of the mobile contact bridge 33. The internal walls of said flanges 68 comprise a layer of insulating material. The positioning of the layers of insulating material on the flanges 68 makes it possible to avoid the attachment of the arc on the internal walls of said flanges 68. These layers are preferably made of gasogenic material.

The extinguishing chamber is also delimited by a back wall 72 placed at right angles to the plane XZ. Said back wall is away from the opening volume 35 to be positioned opposite an opening volume of the contact areas 36, 37. The back wall 72 links the two lateral flanges 68 so as to form a substantially U-shaped metal assembly. The back wall 72 links the two flanges over a part of their height.

Preferably, the two lateral flanges 68 extend in a direction parallel to the median longitudinal plane XZ so as to entirely frame the contact area 36 of the mobile contact bridge 33. More specifically, the two lateral flanges 68 extend in such a way as to completely enclose the contact area 36 of the mobile contact bridge 33 inside the arc-extinguishing chamber 24. In other words, the development of the flanges lengthwise makes it possible to laterally close each opening volume 35 so as to channel the outflow of ionized particles at the time of opening of the electrical contacts.

The wall of each arc-extinguishing chamber 24 can include a top metal baffle 69. As represented in FIG. 18, said baffle electrically links a fixed contact 32 to a back wall 72 to form a top part of the metal wall of said extinguishing chamber.

According to a variant embodiment, the mobile contact bridge 33 comprises arcing horns 39 at each of the two ends. Said arcing horns extend beyond the contact areas toward the back walls 72 of the arc-extinguishing chambers. By way of exemplary embodiment, the arcing horns 39 are inclined relative to the longitudinal axis X of the mobile contact bridge 33.

The casing 31 of the unitary switching block 80 is intended to be positioned in a base 110 of the switching block 100 of the contactor 1. The base 110 comprises an inner face having a first cavity 120 in which unitary switching blocks 80 are positioned. The bottom face 84 of the casing 31 is then positioned facing into the first cavity 120 of the base 110. The main faces 81 are attached to separating partitions 111 of the base 110. The separating partitions 111 positioned on the outer edges of the base 110 thus form walls of the modular electrical switching device 1.

The base 110 comprises a first cavity 120 having at least three compartments intended to collaborate respectively with a unitary switching block 80. Each unitary switching block 80 cooperates with the base 110 to produce at least one outflow channel for the extinguishing gases allowing for a switching without noise or ionized gases outside the base.

Figure 11:
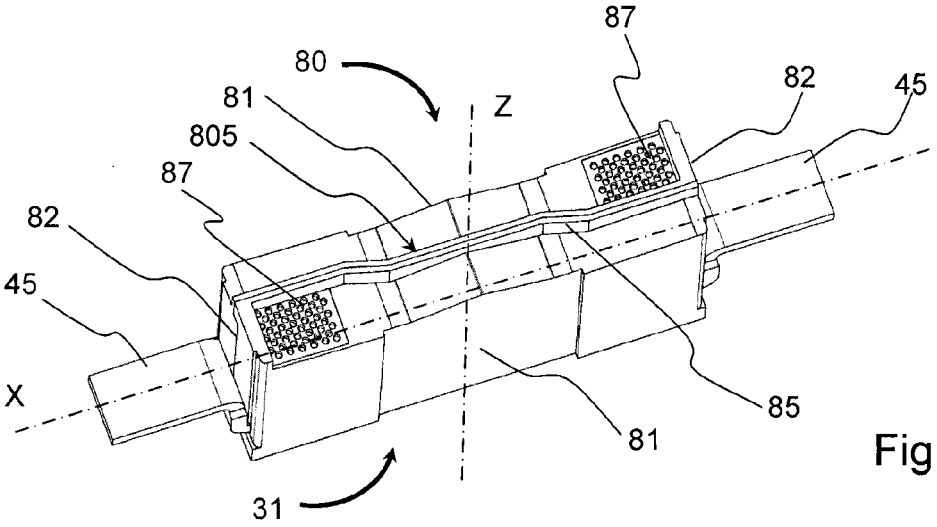
FIG. 11 represents two assembled half-shells of a particular embodiment of a unitary switching block of a switching block according to the invention.
Figure 13:
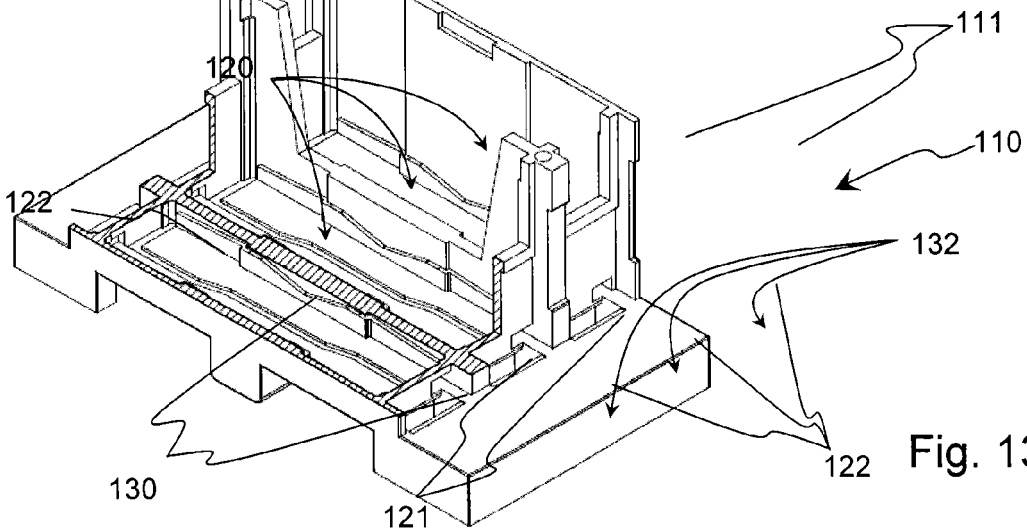
FIG. 13 represents a perspective view of a base of a switching block according to one embodiment of the invention.

According to a particular embodiment of the unitary switching blocks as represented in FIGS. 11 to 13, the two half-shells according to the invention are intended to collaborate with a compartment of the first cavity 120 of a base 110 of a modular electrical switching device 1 in order to delimit two outflow channels for the extinguishing gases. Each outflow channel is then linked to an internal volume of the casing 31 by an opening 86 produced in a half-shell 80A. The half-shells respectively comprise a rib 85 intended to collaborate with a compartment of the first cavity 120 of a base 110 of a modular electrical switching device 1 in order to delimit the outflow channels for the extinguishing gases.

According to a first variant embodiment as represented in FIGS. 11 to 13, the ribs 85 of the two half-shells 80A assembled together form, in a contact plane, a bottom rib 805 on the bottom face 84 of the casing 31. The bottom rib 805 develops in a direction parallel to the longitudinal plane XZ. Said rib is intended to collaborate with the first cavity 120 of a base 110 of a modular electrical switching device 1 in order to delimit two outflow channels for the extinguishing gases, each channel being linked to an internal volume of the casing by an opening 86 produced in a half-shell 80A. In effect, the casing 31 of the unitary switching block 80 is intended to be positioned in a base 110 of a modular electrical switching device 1. The bottom face 84 of the casing 31 is then positioned facing a first cavity 120 of the base 110. More particularly, the bottom rib 805 present on the bottom face 84 of the casing 31 delimits, with the cavity 120, two outflow channels for the extinguishing gases. Each channel is linked to an internal volume of the casing by an opening 86 produced in a half-shell 80A. According to a particular embodiment, the openings 86 preferably pass through the bottom face 84 of the casing 31. More specifically, each half-shell 80A respectively comprises an emergent opening 86. In order to effectively reduce the external manifestations of the extinguishing gases, a filtering block pierced with holes is placed in each outflow channel. By way of exemplary embodiment, a grill 87 is placed on each of the emergent openings 86 of the casing 31. The bottom rib 805 is preferably protruding relative to the bottom face 84. According to this particular embodiment, each compartment of the first cavity 120 of the base 110 comprises a hollow rib 121. The bottom rib 805 protruding from the casing 31 is then arranged in such a way as to be placed in the hollow part of the first cavity 120 of the base 110 at the time of the positioning of the switching block 80 in the modular electrical switching device 1 to delimit two distinct outflow channels. The bottom rib 805 comprises sections of concave and/or convex form. Thus, the bottom face 84 of the unitary switching blocks 80 has a form making it possible to modulate the section of the outflow channel of the gases along this channel so as to alternate areas of expansion and of compression. This alternation of areas of expansion and of areas of compression makes it possible to reduce the quantity of manifestation at the channel outlet. Each compartment of the first cavity 120 is hollow so that the outflow channels for the extinguishing gases comprise walls formed by a part of the bottom face 84 of a unitary switching block 80 and a part of the base 110 of the modular electrical switching device. Each compartment of the first cavity 120 comprises, on a face intended to be placed facing the bottom face 84 of the casing 31 of the unitary switching block 80. Said face comprises a hollow area 121 in which the bottom rib 805 protruding from said casing is intended to be placed to delimit two distinct outflow channels. Furthermore, each compartment of the first cavity 120 of the base 110 comprises a wall in which two outflow holes 122 for the gases are formed. Each hole 122 is linked to one of the outflow channels.

Figure 14:
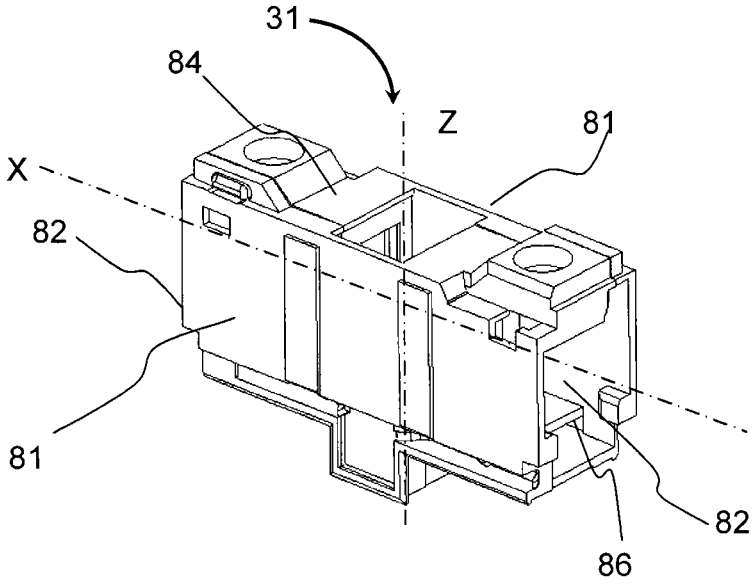
FIG. 14 represents two assembled half-shells of another particular embodiment of a unitary switching block of a switching block according to the invention.

According to a second variant embodiment as represented in FIGS. 14 and 15, the two half-shells respectively comprise a rib 85 on their main face 81. The ribs 85 are preferably set back relative to the main faces 81. The casing 31 comprises two ribs 85 developing in a direction parallel to the longitudinal plane XZ. Said ribs are intended to collaborate with a first cavity 120 of a base 110 of a modular electrical switching device 1. Each channel is linked to an internal volume of the casing by an opening 86 produced in a half-shell 80A. According to a particular embodiment, the openings 86 preferably pass through the bottom face 84 of the casing 31. More specifically, each half-shell 80A respectively comprises an emergent opening 86.

The base 110 further comprises an outer face intended to collaborate with a frame or fixing rail of DIN rail type.

According to one embodiment, the outer face comprises a second cavity 130 having an internal volume delimited by a wall. Said second cavity 130 is thus positioned between the outer face of said base 110 and the first cavity 120 intended for the positioning of a switching block 80.

According to one mode of development of the invention, the second cavity 130 comprises first openings emerging respectively in main walls of the modular contactor 1 and second connecting openings 132 emerging in proximity to the connection lands 45 of the modular contactor 1.

Figure 2:
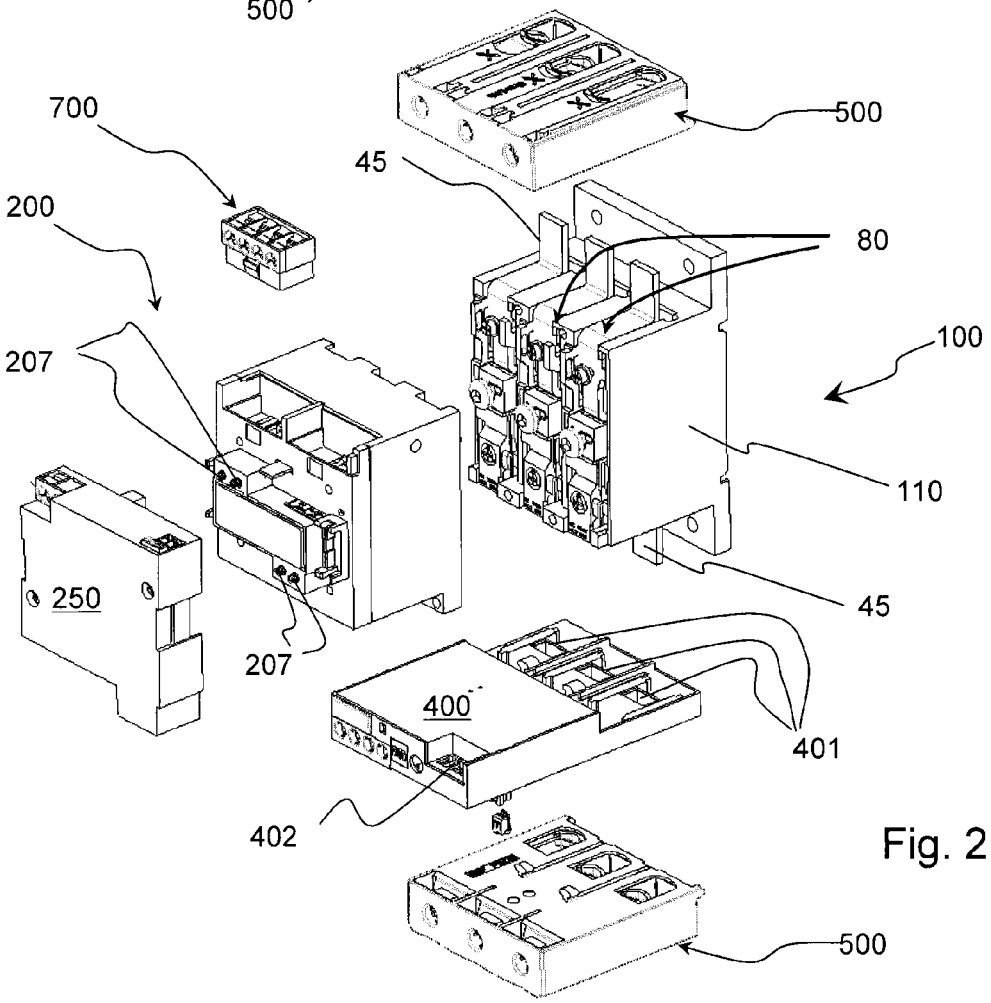
FIG. 2 represents a perspective view of a modular electrical switching device according to FIG. 1 during assembly.
Figure 21:
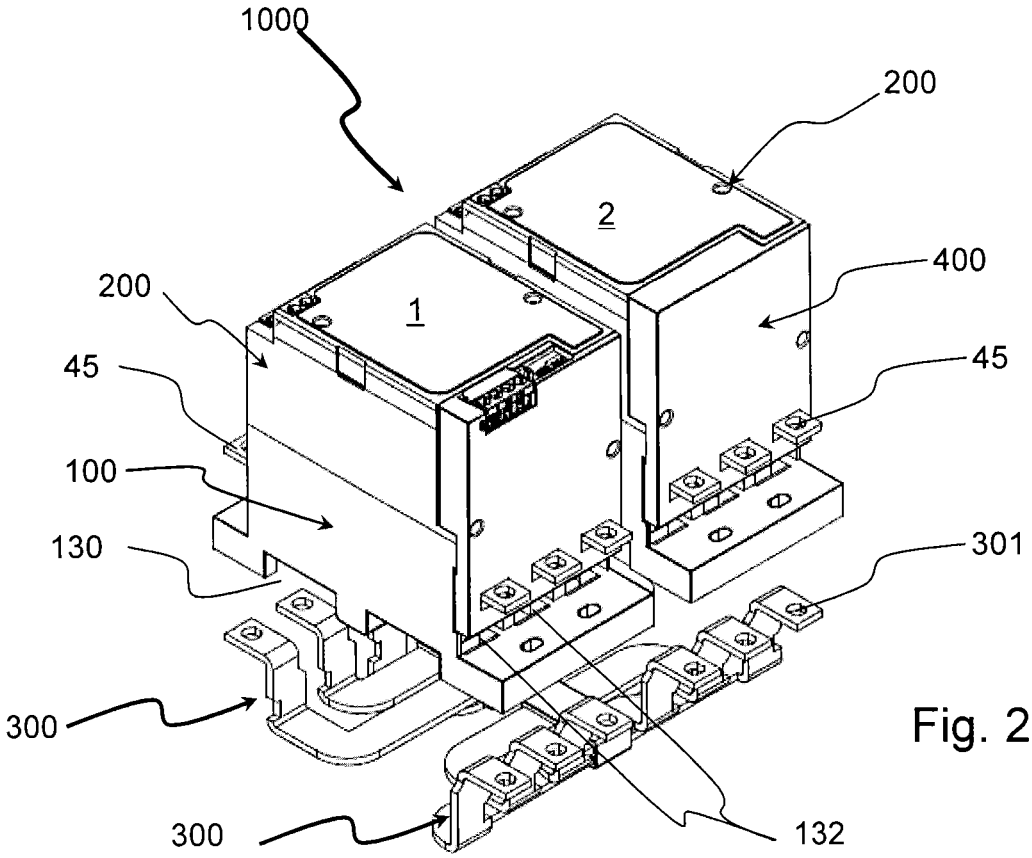
FIGS. 21 and 22 represent perspective views of two switching devices wired in a reversing switch-type mode.
Figure 22:
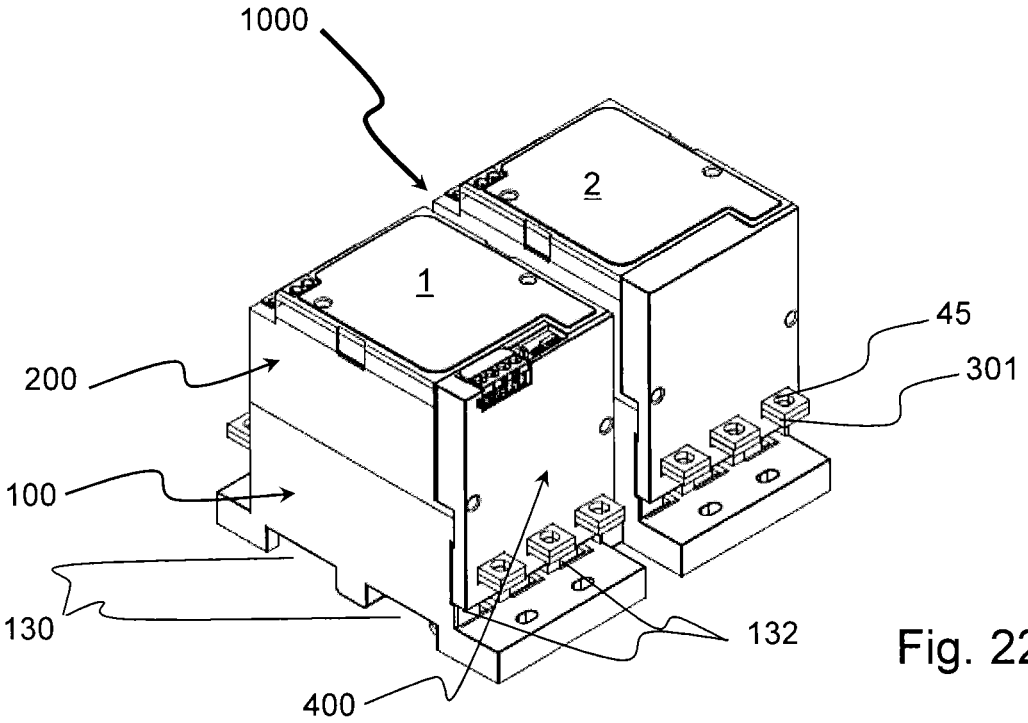

By way of exemplary embodiment, the first openings of the second cavity 130 are preferably produced in a breakable wall of the base 110. Depending on the use of the modular electrical switching device, the breakable part is removed or is not removed. As represented in FIGS. 1 and 2, according to a first embodiment, the breakable parts have not been removed. As represented in FIGS. 21 and 22, the breakable parts of the bases 110 have been removed on the two main faces of the switching device in order to leave a passage for electrical conductors 301.

The first and second openings allow the passage of electrical conductors 301 linking at least one electrical pole of a first modular contactor 1 to an electrical pole of a second modular contactor 2 placed against the first.

According to an embodiment represented in FIGS. 21 to 25, the internal volume of the second cavity 130 is of substantially parallelepipedal form and has an open face on the outer face of the modular contactor 1, 2.

According to a first particular embodiment as represented in FIGS. 21 to 27, the second cavity 130 comprises at least one channel having an edge comprising at least one connecting opening 132 emerging at a connection land 45 of a unitary switching block 80. Said at least one channel extends in a direction substantially at right angles to the longitudinal plane XZ and passes entirely through the base 110 to emerge on either side of said base. By way of exemplary embodiment, said at least one channel comprises a substantially parallelepipedal volume having two substantially parallel edges.

Preferably, the second cavity 130 comprises two substantially identical channels arranged parallel to one another. The channels respectively have a parallelepipedal form. The internal volumes of each channel then comprise first openings emerging respectively in the main walls of the modular contactor 1, 2 and second connecting openings 132 emerging in proximity to the connection lands 45 of the modular contactor 1, 2. Furthermore, the two channels are separated by a partition. Said partition is intended to separate the upstream from the downstream. Said partition can be intended to collaborate with a fixing rail of DIN rail type. Thus, when the second cavity 130 comprises two channels, only one of the two edges of each channel comprises the connecting openings 132. The second connecting openings 132 of a first channel emerge in proximity to the connection lands upstream of the modular contactor 1, 2 and the second connecting openings 132 of a second channel 130 emerge in proximity to the connection lands upstream of the modular contactor 1, 2.

When the second cavity 130 comprises a single channel of parallelepipedal form, the connecting openings 132 are arranged in the two parallel edges of the channel, each edge comprising, respectively, the connecting openings suitable for being passed through by one of the reversing bars of the reversing bar set.

According to a second particular embodiment not represented, the second cavity 130 comprises two slots cut respectively in the lateral faces of the base 110. These slots emerge respectively at the connection lands 45 of the unitary switching blocks 80. Each slot is intended to receive a complete reversing bar set 300 comprising one or more reversing bars 301.

As represented in FIG. 1, the modular electrical switching device 1 can further comprise one or more fault detection devices, notably thermal. The detection devices are linked to the actuation block 200 in order to control the opening of the electrical contacts via the actuator. According to an embodiment of the invention as represented in FIG. 1, the modular electrical switching device 1 comprises a removable thermal protection module 400.

As represented in FIGS. 1 and 2, a removable thermal protection module 400 according to the invention comprises a casing in which one or more current sensors of annular form are positioned. Said sensors are intended to be positioned around the connection lands 45 of the unitary switching blocks 85 of the switching block 100. The current sensors can be of Rowgoski type. According to a particular embodiment represented in FIGS. 1 and 2, the removable thermal protection module 400 is adapted to a three-pole modular contactor and thus comprises three openings 401 allowing it to be positioned by fitting on the connection lands 45 of the three single-pole switching blocks 85. As represented in FIG. 2, the removable thermal protection module 400 has the particular feature of being incorporated in the modular contactor 1 in such a way as to be inserted between the switching block 100 and the connection terminal blocks 500.

The removable thermal protection module 400 according to the invention has the particular feature of not having specific electrical power supply means. According to a preferential embodiment of the invention, the removable thermal protection module 400 comprises communication and electrical power supply means 402 intended to be connected automatically with the removable electrical control module 250 of the actuation block 200. Thus, these communication and electrical power supply connection means 402 are suitable for both powering the removable thermal protection module 400 and for transmitting the measurements performed by the current sensors. According to this embodiment of the invention, the positioning of the removable electrical control module 250 on the casing of the actuation block 200 allows the automatic connection and electrical power supply between the current sensors of the removable thermal protection module 400 and the removable electrical control module 250.

According to a preferential embodiment of the invention, the means for rapidly fixing the actuation block 200 with the switching block 100 comprise a first part secured to the mobile keeper 202 of the actuation block 200 and a second part secured to the switching block 100.

The rapid fixing means comprise at least one coupling hook 214 intended to fix and secure the switching block 100 to the actuation block 200.

Said coupling hook 214 is secured to the mobile keeper 202 of the electromagnetic actuator and is suitable for collaborating with an actuation device 34 of the mobile contact 33 of the switching block 100 to transmit the movement of the mobile keeper 202 to the mobile contact 33.

Thus, according to a preferential embodiment of the invention, the coupling hook 214 is intended to both fix the actuation block 200 with the switching block 100 and transmit the movement of the mobile keeper 202 from the electromagnetic actuator to the mobile contact bridge 33 of a unitary switching block 80 of the switching block 100.

The actuation device 34 of the mobile contact 33 comprises a mobile contact-holder 38 secured to the mobile contact 33. Said mobile contact-holder 38 is linked to an attachment head 51. According to an embodiment of the invention, the mobile contact 33 is preferably slidingly mounted on the mobile contact-holder 38.

Contrary to the known solutions, the mobile contact-holder 38 forms an integral part of the unitary switching block 80 and does not form part of the mobile part of the electromagnetic actuator of the actuation block 200. Each unitary switching block then respectively comprises a mobile contact-holder 38 secured to the mobile contact 33. As represented in FIG. 2, the switching block 100 of the modular contactor 1 according to the invention comprises three unitary switching blocks 80 respectively having a mobile contact-holder 38. Each unitary switching block then has autonomous operation relative to the other unitary blocks.

The coupling hook 214 preferably has a C-shaped profile having two substantially parallel edges. Said edges comprise bearing surfaces suitable for transmitting the movements of the mobile keeper 202 moving from its closed position to its open position and vice versa.

A first edge of the coupling hook 214 comprises a slot which is intended to receive the attachment head 51 secured to the contact-holder 38. The first edge comprises a bearing surface intended to transmit the movement of the mobile keeper 202 to the mobile contact-holder 38 of the mobile contact 33 in a first direction of movement, notably from the closed position of the mobile keeper 202 to its open position. A second edge comprises a bearing surface intended to transmit the movement of the mobile keeper 202 to the mobile contact-holder 38 of the mobile contact 33 in a second direction of movement, notably from the open position of the mobile keeper 202 to its closed position.

According to one mode of development of the invention, the fixing means 210 comprise a tray 211 intended to be fixed to the mobile keeper 202. According to a particular embodiment, the tray 211 comprises a counterbore on a first face. A part of the mobile keeper 202 is intended to be positioned by countersinking in said counterbore. The fixing means 210 comprise removable securing keys 212 passing through the walls of the counterbore and a part of the mobile keeper 202. By way of exemplary embodiment, the form of the counterbore of the tray 211 is substantially rectangular to receive the transverse keeper securing the outer branches of the U-shaped mobile keeper of the mobile keeper 202. Said transverse keeper comprises through-holes allowing the passage of the removable securing keys 212 when fixing the mobile keeper 202 with the tray 211.

According to a particular embodiment, the tray 211 comprises three coupling hooks 214 intended respectively to collaborate with an attachment head 51 of a mobile contact-holder 38 secured to the mobile contact 33 of a unitary switching block 80. According to this particular embodiment of the invention, three unitary switching blocks 80 are then controlled in a synchronized manner by the actuation block 200 acting on the unitary switching blocks. As has been specified above, the unitary switching blocks 80 can be controlled in a synchronized and simultaneous manner or a synchronized and non-simultaneous manner. Each unitary switching block 80 is linked to the actuation block 200 and is controlled on the opening of the contacts 32, 33 by translationally displacing the mobile contact bridge 33 in a direction at right angles to the longitudinal axis X. The mobile contact bridge 33 is displaced between a position of opening and a position of closure of the electrical contacts.

Contrary to the prior art solutions, the coordination on the opening of the different unitary switching blocks 80 is produced directly by the actuation block 200 and not by additional means such as, notably, by control axes linking the unitary switching blocks. Thus, by virtue of the solution of the invention, when the actuation block 200 is detached from the fixing block 100, each unitary switching block 80 can be directly removed from the base 110 of the fixing block 100. This removal can be performed independently of that of the other unitary switching blocks 80.

The modular contactor 1 according to the invention then comprises rapid fixing means 210 allowing the actuation block 200 to be fixed removably to the switching block 100.

According to a preferential embodiment, the coupling hook 214 comprises play take-up means suitable for eliminating plays necessary for the mounting of the actuation block 200 on the switching block 100. These play take-up means thus guarantee that a reduced chain of dimensions is observed.

The play take-up means comprise an elastic blade 213 positioned substantially parallel to the second edge of the coupling hook 214. Said elastic blade 213 behaves like a blade damper by being deformed in the direction Z as soon as it enters into contact with the attachment head 51 linked to a mobile contact-holder 38 secured to a mobile contact 33. In other words, the play take-up is produced in such a way that it makes it possible to avoid the relative displacements of the different parts during the electrical or mechanical maneuvers of the modular contactor. The play take-up means thus make it possible to achieve high levels of mechanical durability. According to a variant embodiment not represented, a single elastic play take-up blade could be used and then be common to all three unitary switching blocks.

According to an embodiment as represented in FIG. 5A, the elastic blade 213 is positioned in a housing of the tray 211. The elastic blade 213 is preferably metallic and is produced by folding. Said blade comprises positioning snugs intended to be placed inside the tray 211 in order to limit any displacement of said blade.

The elastic blade 213 has a dual function. It makes it possible on the one hand to recover the play between the tray 211 and attachment head 51 and, on the other hand, recover the play between the tray 211 and the mobile keeper 202 of the electromagnetic actuator. The wavy form of the elastic blade 213 has the effect of locating the attachment head 51 in the axis of the mobile assembly 220 and of allowing the installer to feel a snap-fitting or hard point sensation confirming the correct assembly of the two parts to one another.

According to one embodiment of the invention, as represented in FIGS. 4, 5 and 6, each mobile bridge 33 of a unitary switching block 80 comprises an attachment head 51 intended to be linked to a coupling hook 214 of a tray 211 of a mobile keeper 202 of the electromagnetic actuator. The attachment head 51 comprises bearing surfaces intended to collaborate with the bearing surfaces of the two edges of the C-shaped coupling hook 214. According to one particular embodiment, the attachment head comes to be positioned between the two edges of the coupling hook 214. The attachment head 51 is linked to the mobile contact-holder 38 by a transmission axis 52. The transmission axis 52 then comes to be positioned inside the slot of the first edge of the coupling hook 214.

According to a preferential embodiment of the invention, the position of the attachment head 51 can be adjusted according to the direction of displacement of the mobile contact bridge 33, in other words in a direction at right angles to the longitudinal axis X. This adjustment makes it possible to optimize the contact compression travel between the electrical contact areas 37 of the two fixed contacts 32 and the contact areas 36 of the mobile contact bridge 33.

The mobile contact bridge 33 of each unitary switching block 80 is displaced between a position of opening and a position of closure of the electrical contacts. The aim is to guarantee that, for a given displacement travel, the electrical contacts are indeed in the position of closure. The displacement travel is set by the electromagnetic actuator of the actuation block 200.

Depending on the manufacturing tolerances of a unitary switching block 80, the distance separating the mobile contact bridge 33 from the fixed contacts 32 in the position of opening of the contacts can vary from one unitary switching block 80 to another.

Thus, for one and the same displacement travel of the actuator of the actuation block 200, the final positions of the mobile contact bridges 33 can be different. For a multiple-pole contactor having a single actuator simultaneously controlling a number of mobile switching bridges 33, it is possible for all the mobile switching bridges not to have reached the same position of closure. In other words, by way of example, a mobile switching bridge 33 of a unitary switching block 80 may not be totally in a position of closure whereas the other mobile bridges 33 of the other unitary switching blocks are already in a position of closure.

Setting the compression travel of the contacts consists in guaranteeing that a mechanical dimension will be kept between the attachment head 51 and the casing 31 of the unitary switching block 80 in the position of closure of the contacts. More specifically, setting the compression travel of the contacts consists in guaranteeing that a dimension is kept between the bearing surfaces of the attachment head 51 and a reference surface of the casing 31 of the unitary switching block 80. This dimension will be reproduced for all the unitary switching blocks of one and the same modular contactor 1 according to the invention.

The compression travel is set using the transmission axis 52 linking the attachment head 51 to the mobile contact-holder 38. According to one embodiment of the invention, said transmission axis 52 is of variable length.

According to a particular embodiment of the invention, the transmission axis 52 comprises a first end fixed to the attachment head 51 and a second end comprising a threading. The threading is intended to collaborate with a tapping produced in the mobile contact-holder 38 secured to the mobile contact bridge 33. By screwing the transmission axis 52 more or less into the mobile contact-holder 38, the attachment head 51 is displaced relative to the casing 31 of the unitary switching block 80.

By way of exemplary embodiment of the attachment head 51, the latter comprises a cavity intended to collaborate with a setting tool (not represented). The setting tool is intended to be manipulated by a user wanting to set the length of the transmission axis 52. As represented in FIGS. 2 and 10A, the attachment head can comprise, for example, a dome-headed profile. As represented in FIG. 16, the attachment head can comprise, for example, a hexagonal profile.

The method for setting the compression travel of the electrical contacts of a unitary switching block 80 consists in placing the mobile contact-holder 38 in a position of closure of the electrical contact 32, 33. The compression travel of the contacts can also be called wear guard. This operation is generally performed manually before the casing 31 of the unitary switching block 80 is mounted on the base 111 of the switching block 110. The next step consists in positioning a setting template 600 between the outer surface of the casing 31 and a bearing surface of the attachment head 51. If the distance between the casing and the attachment head 51 is less than the thickness of the setting template 600 and does not allow the positioning of said template, the transmission axis 52 is then lengthened notably by unscrewing it relative to the casing 31. Conversely, if the distance between the casing 31 and the attachment head 51 is greater than the thickness of the setting template 600, the transmission axis 52 is then shortened notably by screwing it relative to the casing 31. When the length of the transmission axis 52 has been set, the setting template 600 can be removed.

Figure 6A:
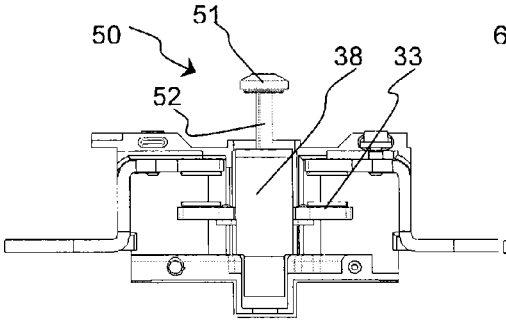
FIGS. 6A, 7A and 8A represent cross-sectional views of a unitary switching block during steps of a method for setting the contact compression travel according to the invention.
Figure 7A:
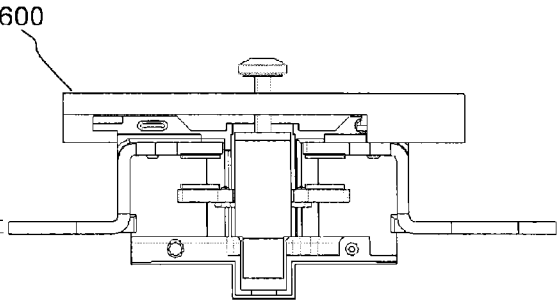
Figure 6B:
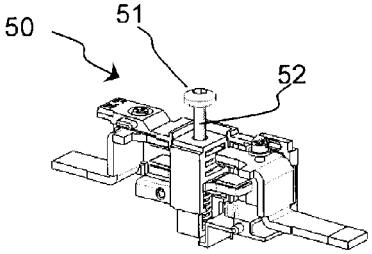
FIGS. 6B, 7B and 8B represent perspective views of a unitary switching block during steps of the method for setting the contact compression travel according to the invention.
Figure 7B:
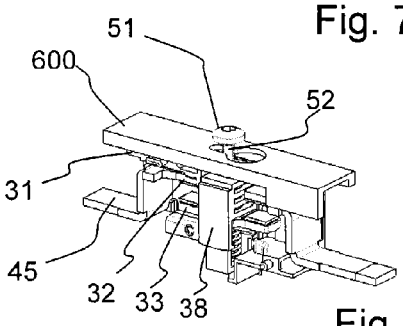
Figure 8A:
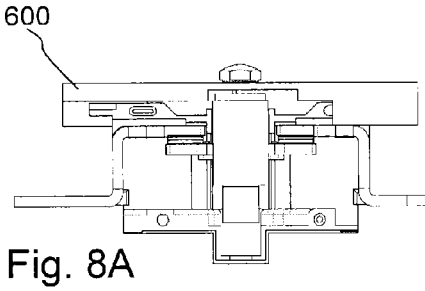
Figure 9A:
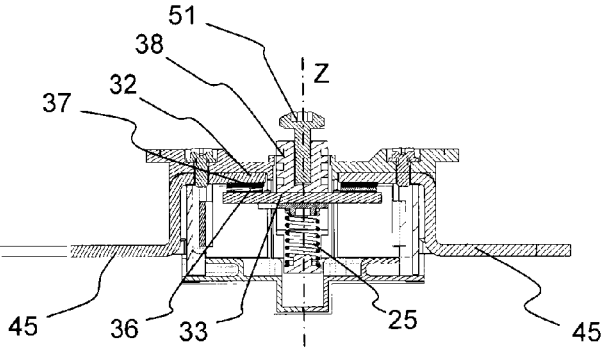
FIGS. 9A and 9B represent cross-sectional views of a unitary switching block respectively in a position of opening and a position of closure.
Figure 8B:
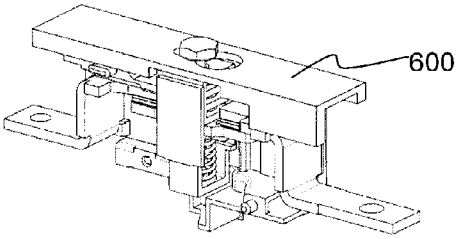
Figure 9B:
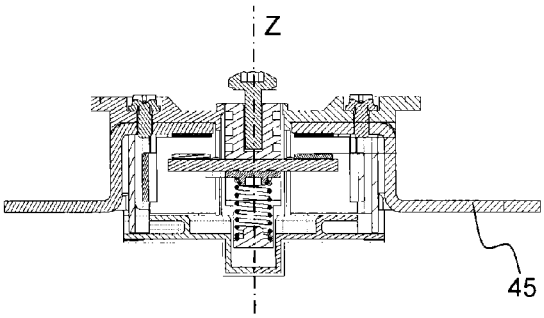

According to a particular embodiment of the setting method, as represented in FIGS. 6A and 6B, the first step consists in increasing to the maximum the length of the transmission axis 52, notably by unscrewing it to the maximum. The second step as represented in FIGS. 7A and 7B, consists in positioning the setting template 600 between a bearing surface of the attachment head 51 and a reference surface of the casing 31 of the unitary switching block 80. In a third step, the mobile contact-holder 38 is then brought into a position of closure of the electrical contacts 32, 33 by screwing the transmission axis 52. As represented in FIGS. 8A and 8B, the attachment head 51 finishes by bearing on the setting template 600 and the mobile contact-holder 38 is in the position of closure. In a final step represented in FIGS. 9A and 9B, the setting template 600 is removed and the mobile contact-holder 38 is positioned in a position of opening of the contacts 32, 33.

According to one embodiment of the invention, the presence of a transmission axis 52 of variable length on each unitary switching block 80 also makes it possible to create a temporal offset or a synchronization in the opening of the mobile contacts 33 of the unitary switching blocks 80 of one and the same modular switching device according to the invention.

This time offset in the opening of the electrical poles of a modular switching device notably makes it possible to reduce the wear of the contacts on the opening of a three-phase product, by deliberately advancing the opening of one pole relative to the other two.

In effect, in three-phase switching, there is always one electrical pole which switches before the other two. The other two poles then cut off a network which has become single-phase following the first switching. The offset makes it possible to guarantee the three-phase switching always on the same pole that can then be synchronized relative to the zero current. The opening of the other two poles is offset so as to reduce to the maximum the arc time on these two poles.

This time offset in the opening of the electrical poles of a modular switching device also makes it possible to guarantee, for certain four-phase applications, an advance or a delay in the opening of the neutral relative to the phases.

According to another embodiment of the setting method, this operation can be performed simultaneously for all the unitary switching blocks 80 positioned in a unitary, two-pole, three-pole or four-pole base. A template associated with the number of poles present is then used. In this same embodiment, a time offset in the opening of one or more poles can easily be produced by a template incorporating the offset of the pole for which the closure has to be advanced or delayed.

Thus, by virtue of the rapid fixing means, the mounting and/or the dismantling of the switching block 100 relative to the actuation block 200 can be performed easily which facilitates, for example, maintenance interventions notably on the switching block.

Furthermore, the positioning references of the actuation block 200 relative to the preset unitary switching blocks of the switching block 100 make it possible to guarantee a very reduced tolerance of the wear guard of the contacts and do so in the event of the changing of the unitary blocks as part of the maintenance intervention. The wear guard of the contacts is also called contact compression. This then has the effect of guaranteeing a low tolerance on the electrical endurance despite the manufacturing tolerances of any industrial product, and simultaneously allowing for a saving of contact material (silver-based) and a lower consumption of the actuator.

As represented in FIG. 2, the modular contactor 1 according to the invention comprises connection terminal blocks 500 intended to be connected to the connection terminals 45 of the switching block.

According to a particular embodiment of the invention as represented in FIGS. 28A to 30B, the electrical switching device 1 comprises additional removable auxiliary contact blocks 700. These blocks have the particular feature of being removable.

The removable auxiliary contact blocks 700 comprise a mobile contact support MCS which is controlled upon opening either by the operating axis 216 of the mobile assembly 220 through the tray 211 being displaced in a translational movement or by the multifunction lever 205 being displaced in a rotational movement.

Figure 28B:
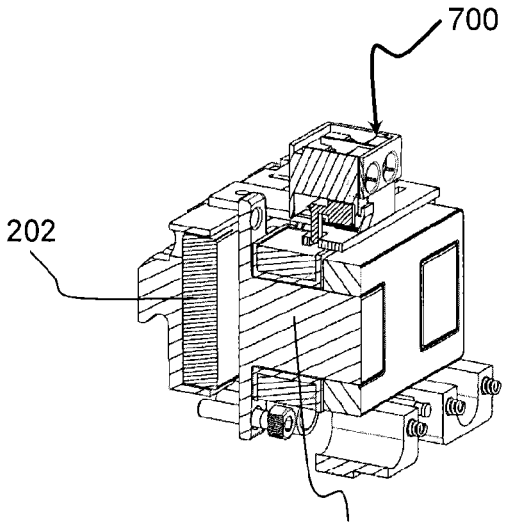

According to an exemplary embodiment as represented in FIGS. 28A and 28B, the removable auxiliary contact blocks 700 are controlled by a translational movement of the mobile assembly 202 to indicate the open or closed state NO/NC of the electrical switching device 1. Said add-on block is mounted vertically relative to the position of installation.

According to an exemplary embodiment as represented in FIGS. 29A and 29B, the removable auxiliary contact blocks 700 are controlled by a rotational movement of the multifunction lever 205. The add-on blocks are mounted frontally relative to the position of installation.

Figures 30A, 30B:
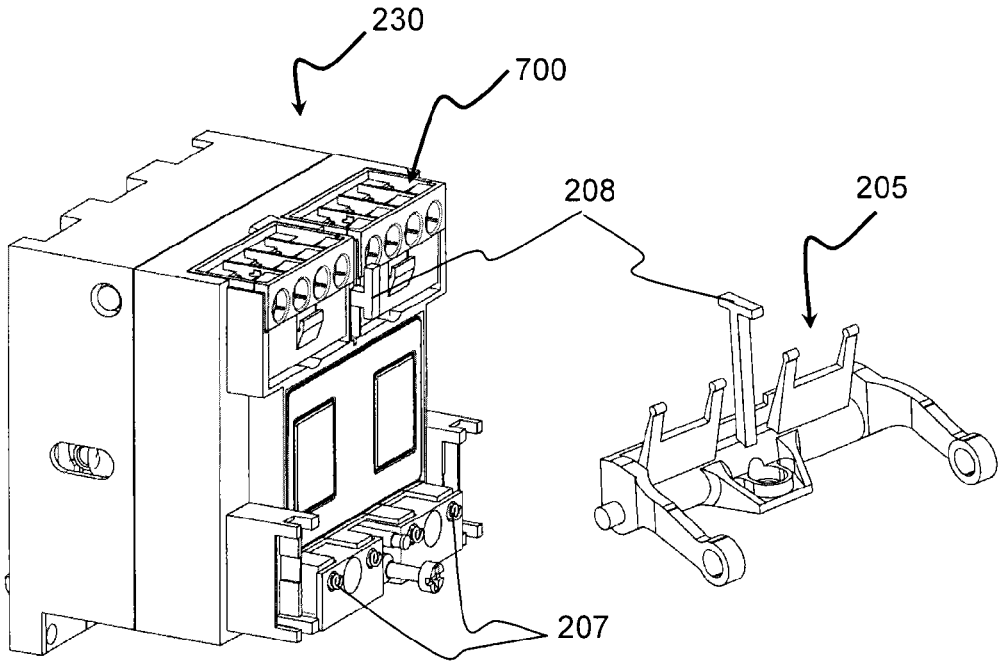
FIGS. 30A and 30B represent perspective views of a variant embodiment of the control means of the auxiliary contact blocks according to FIGS. 29A and 29B.

According to a variant embodiment as represented in FIGS. 30A and 30B, the multifunction lever 205 can offer the possibility, via a particular form of flag type, of indicating the state of opening of the electrical switching device 1. This mechanical visualization of the position of the electrical switching device 1 can be produced by an angular displacement of the lever 205 comprising a flag 208.

As represented in FIGS. 21 and 22, the invention relates to a switching assembly 1000 comprising two modular contactors 1, 2 as defined above. Said modular contactors 1, 2 of the switching assembly 1000 are placed side-by-side so as to be attached by one of their main faces. Furthermore, the two modular contactors 1, 2 are electrically connected. The switching assembly 1000 comprises electrical conductors 301 positioned respectively inside second cavities 130 of the two bases 110 of the two modular contactors 1, 2. The electrical conductors 301 linking the electrical poles of the first modular contactor 1 to the electrical poles of the second modular contactor 2 comprise rigid or semi-rigid conductors 301.

According to a particular embodiment of the connection assembly, the internal volume of the second cavity 130 is intended to receive sets of reversing bars 300 suitable for linking two modular contacts 1, 2 according to a reversing switch mode as represented in FIGS. 21 and 22. As represented in FIG. 22, the two contactors 1, 2 linked set by the set of reversing bars 300 are contactors of three-pole type. The set of bars 300 then comprises six reversing bars 301 respectively linking two connection lands 45 of two contactors. As represented in FIGS. 21 to 27, the electrical conductors 301 of the switching assembly 1000 are arranged in two groups 300 respectively comprising three reversing bars 301. Advantageously, the electrical conductors 301 of one and the same group 300 are secured by a clamp 302.

Figure 23:
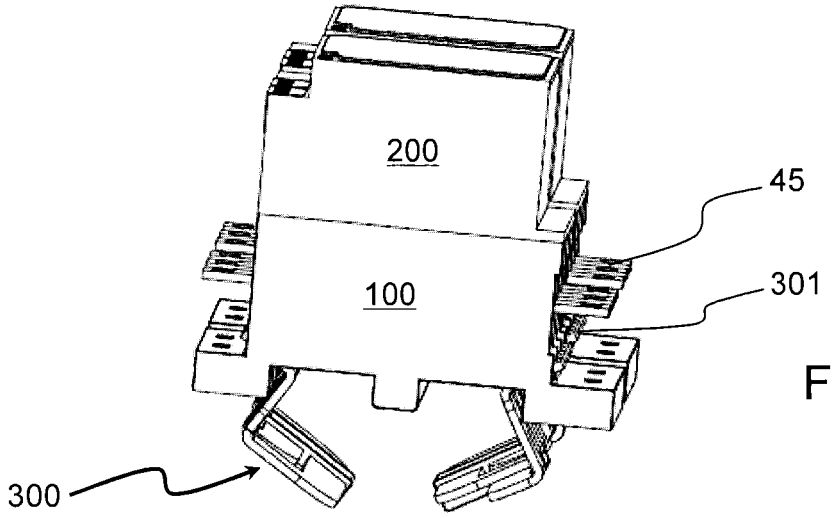
FIGS. 23 to 25 represent perspective side views of two switching devices wired in a reversing switch-type mode.
Figure 24:
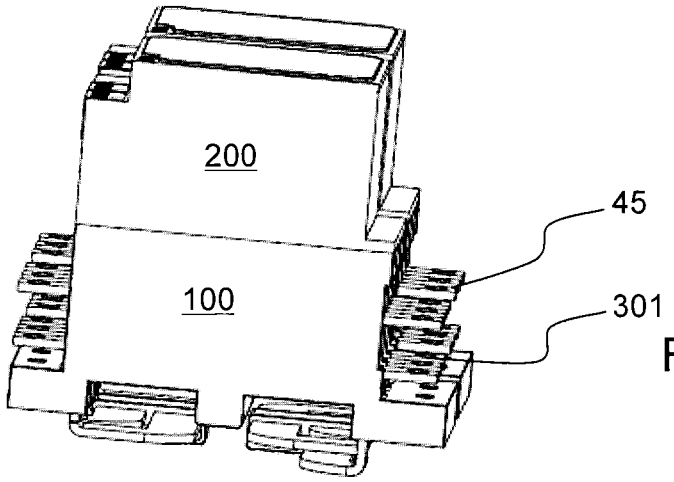
Figure 25:
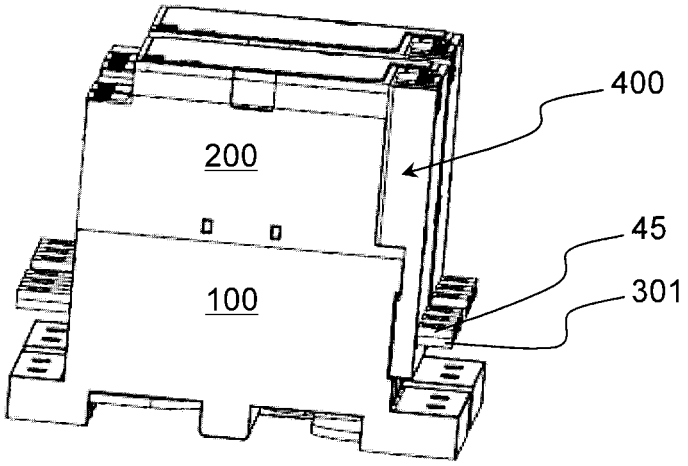

Each connection opening 132 of a second cavity 130 emerging at a connection land 45 of a unitary switching block 80 is then passed through by one of the reversing bars 301 of the set of reversing bars 300. Thus, each connection opening 132 allows for the passage and the positioning of a reversing bar alongside a connection land 45 in such a way that the electrical contact between the land and the bar can take place. According to this first particular embodiment, as represented in FIGS. 23 to 25, the placement of the reversing bars 301 of the set of reversing bars 300 is done through the outer face of the base 110. After having slid the ends of the reversing bars 301 into the connection openings 132, the set of bars 300 undergoes a slight rotation to come to be positioned inside the second cavity 130.

According to a second particular embodiment not represented, the placement of the reversing bars 301 of the set of reversing bars 300 is done directly through the lateral face of the base 110. The set of reversing bars 300 is positioned in the slot of the second cavity 130 by sliding it therein. The ends of the reversing bars 301 are then directly attached to the connection lands 45.

This three-pole reversing switch mode is particularly suited to the control of electric motors. According to a particular embodiment, an upstream connection land 45 of the first electrical pole of the first modular contactor 1 is linked to an upstream connection land 45 of the first electrical pole of the second modular contactor 2. Furthermore, a downstream connection land 45 of the first electrical pole of the first modular contactor 1 is linked to a downstream connection land 45 of the third electrical pole of the second modular contactor 2. An upstream connection land 45 of the second electrical pole of the first modular contactor 1 is linked to an upstream connection land 45 of the second electrical pole of the second modular contactor 2. A downstream connection land 45 of the second electrical pole of the first modular contactor 1 is linked to a downstream connection land 45 of the second electrical pole of the second modular contactor 2. An upstream connection land 45 of the third electrical pole of the first modular contactor 1 is linked to the upstream connection land 45 of the third electrical pole of the second modular contactor 2. Finally, a downstream connection land 45 of the third electrical pole of the first modular contactor 1 is linked to the downstream connection land 45 of the first electrical pole of the second modular contactor 2.

Furthermore, this embodiment can be applied to four-pole contactors (not represented) intended for the reversal of electrical power sources.

Thus, according to the connection mode in reversing switch mode of two modular contactors according to the invention, the two sets of bars 300 are placed inside the contactors. This innovative configuration makes it possible to not increase the overall volume of the electrical installation. This offers a significant advantage over the prior art solutions where the installation of the sets of bars outside (FIG. 19) leads to problems at the time of the wiring of the contactors in the electrical cabinets. In effect, the space inside these electrical cabinets is always limited.

Furthermore, this configuration of the sets of reversing bars inside the modular contactors 1, 2 according to the invention also makes it possible to incorporate a removable measurement and thermal protection module 400 in one of the two modular contactors 1, 2 as is represented in FIGS. 21 and 22.

Figure 19:
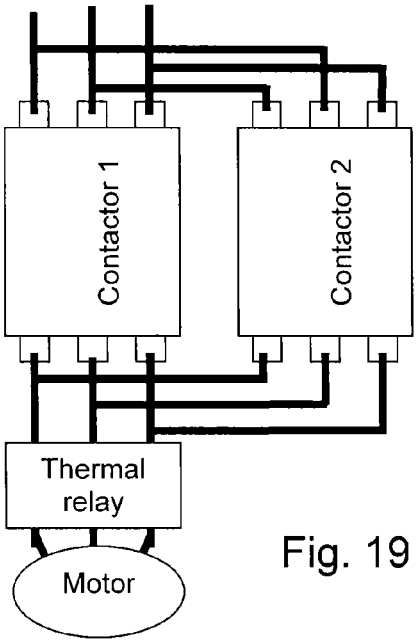
FIG. 19 represents a wiring diagram of two switching devices placed upstream of a motor in a reversing switch-type mode.
Figure 20:
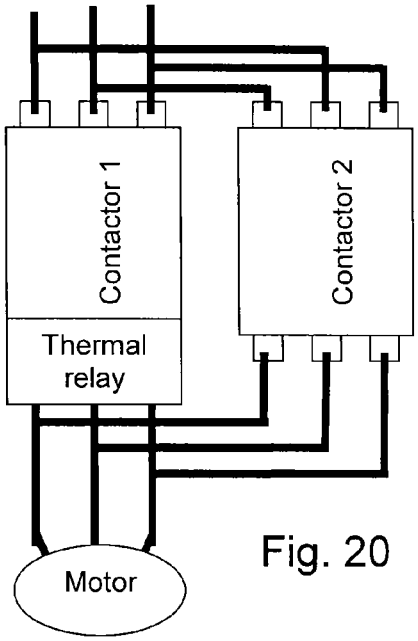
FIG. 20 represents a wiring diagram according to FIG. 19 according to a non-functional embodiment.
Figure 26:
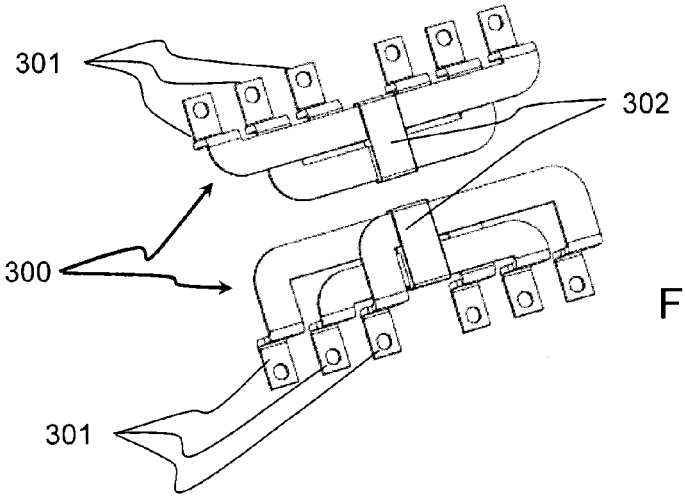
FIGS. 26 and 27 represent perspective views of link bars used to link two modular switching devices in a reversing switch-type mode.
Figure 27:
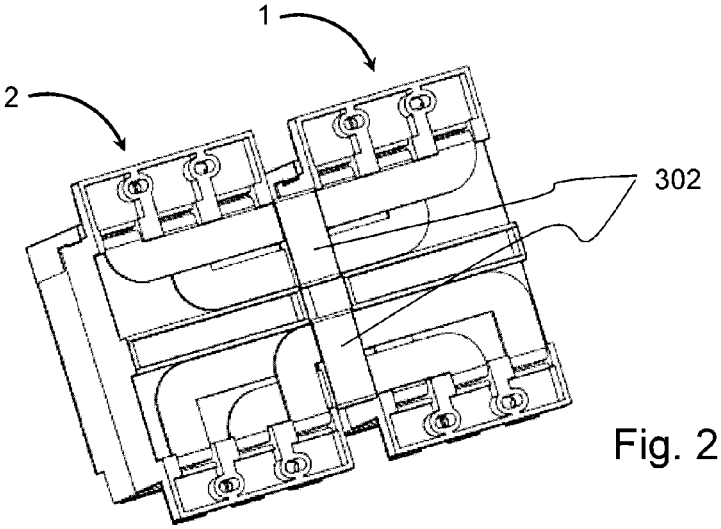

This incorporation of a removable thermal protection module 400 on one of the two contactors 1, 2 is impossible with a known wiring as represented in FIG. 19. In effect, if a user tries to convert the wiring of two contactors placed in a mode of reversing switch type as represented in FIG. 19 by incorporating the thermal protection (thermal relay) on one of the two contactors then, as represented in FIG. 20, a non-functional wiring is obtained. In effect, according to this unsatisfactory embodiment, when the motor is powered by contactor number 2, the thermal relay is no longer on the current flow and cannot therefore indicate the thermal state of the motor.

As represented in FIGS. 21 and 22, one of the modular contactors 2 of the switching assembly 1000 does not include any removable thermal protection module 400. Said modular contactor 2 comprises an actuation block 200 associated with a switching block 100 not equipped with a removable thermal protection module 400.

The invention is particularly intended for the multiple-pole switching apparatuses of the contactor or starter type with electronic control. The architecture with simplified modular structure of these apparatuses makes it possible to accept one or more switching bocks, as well as a removable thermal protection in the volume of the device. This architecture allows for easy and differentiated maintenance of the various modular elements, whether electrical, electronic or electromechanical.

The invention claimed is:

1. A modular electrical switching device comprising:

a switching block comprising unitary switching blocks respectively comprising electrical switching means;

an actuation block comprising an actuation module of the unitary switching blocks, the module incorporating an electromagnetic actuator controlled by control means;

means allowing the actuation block to be removably fixed onto the switching block;

a removable electrical control module incorporating the control means and comprising adaptive connection means configured to be interconnected with an actuation coil of the electromagnetic actuator when the removable electrical control module is positioned on the actuation module;

rapid fixing means allowing a removable fixing of the actuation block onto the switching block and comprising at least one coupling hook configured:

to fix and secure the switching block to the actuation block, and to collaborate with an actuation device of a mobile contact of the unitary switching block to transmit movement of the electromagnetic actuator to the mobile contact;

the coupling hook being secured to a mobile keeper of the electromagnetic actuator.

2. The modular electrical switching device as claimed in claim 1, wherein the actuation coil comprises control windings respectively comprising connection terminals;

in a first configuration, the adaptive connection means of the removable electrical control module is arranged to be connected to the connection terminals and place the control windings in series, and in a second configuration, the adaptive connection means is arranged to be connected to the connection terminals and place the control windings in parallel.

3. The modular electrical switching device as claimed in claim 2, wherein the adaptive connection means comprises electrical tracks directly incorporated in a printed circuit of the removable electrical control module to connect two control windings in series.

4. The modular electrical switching device as claimed in claim 2, wherein the adaptive connection means comprises electrical tracks directly incorporated in a printed circuit of the removable electrical control module to connect the control windings in parallel.

5. The modular electrical switching device as claimed in claim 1, further comprising a removable thermal protection module comprising, in a casing, current sensors configured to be positioned around connection lands of the unitary switching blocks of the switching block, the casing being removable relative to the modular switching device.

6. The modular electrical switching device as claimed in claim 5, wherein the removable thermal protection module comprises communication and electrical power supply means configured to be automatically connected with the removable electrical control module, the communication and power supply means being arranged to power the removable thermal protection module and to transmit measurements performed by the current sensors.

7. The modular electrical switching device as claimed in claim 1, wherein the unitary switching blocks are respectively controlled in a synchronized manner by the actuation block to control opening of the electrical contacts by displacing the mobile contacts.

8. The modular electrical switching device as claimed in claim 1, wherein the coupling hook of the fixing means is secured to a mobile keeper of the electromagnetic actuator.

9. The modular electrical switching device as claimed in claim 8, wherein the coupling hook comprises an edge comprising a bearing configured to transmit movements of the mobile keeper to the mobile contact from a closed position to an open position and vice versa.

10. The modular electrical switching device as claimed in claim 9, wherein a first edge of the coupling hook comprises a slot configured to receive an attachment head of a mobile contact-holder, the first edge comprising a bearing surface configured to transmit the movement of the mobile keeper to a mobile contact-holder of the mobile contact in a first direction of movement from the closed position to its open position.

11. The modular electrical switching device as claimed in claim 9, wherein a second edge comprises a bearing surface configured to transmit the movement of the mobile keeper to the mobile contact-holder of the mobile contact in a second direction of movement, from the open position to its closed position.

12. The modular electrical switching device as claimed in claim 8, comprising three unitary switching blocks, the actuation devices of the blocks being respectively controlled in a synchronized manner by the actuation block to control opening of the electrical contacts by displacing the mobile contacts.

13. The modular electrical switching device as claimed in claim 12, wherein the actuation block comprises a tray fixed to the mobile keeper, the tray comprising three coupling hooks configured respectively to collaborate with an attachment head of a snug of a mobile contact-holder secured to a mobile contact of a unitary switching block.

14. An electrical switching assembly comprising first and second modular electrical switching devices as claimed in claim 1, the devices placed side-by-side being electrically connected, and comprising electrical conductors positioned respectively in second cavities of two bases of the two modular contactors.

* * * * *